US006661743B1

(12) United States Patent
Mafune et al.

(10) Patent No.: US 6,661,743 B1
(45) Date of Patent: Dec. 9, 2003

(54) ELECTRONIC DEVICE WITH DISPLAY SECTION

(75) Inventors: Masao Mafune, Kawagoe (JP); Masahiro Sase, Fussa (JP); Kenji Fujita, Sayama (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/486,593

(22) PCT Filed: Sep. 1, 1998

(86) PCT No.: PCT/JP98/03887

§ 371 (c)(1),
(2), (4) Date: Mar. 1, 2000

(87) PCT Pub. No.: WO99/12073

PCT Pub. Date: Mar. 11, 1999

(30) Foreign Application Priority Data

Sep. 1, 1997 (JP) ..... 9-235840
Sep. 12, 1997 (JP) ..... 9-248555

(51) Int. Cl.[7] ..... G04C 19/00; G04C 17/00

(52) U.S. Cl. ..... 368/82; 368/84; 368/239; 368/242

(58) Field of Search ..... 368/281, 282, 368/242, 241, 82, 84, 239

(56) References Cited

U.S. PATENT DOCUMENTS 4,017,154 A * 4/1977 Kobayashi ..... 345/33
4,205,522 A * 6/1980 Takami ..... 349/71
4,413,915 A * 11/1983 Besson ..... 349/113
4,435,046 A * 3/1984 Nishimura ..... 349/142
4,488,818 A * 12/1984 Saurer et al. ..... 368/242
6,147,934 A * 11/2000 Arikawa et al. ..... 349/96

FOREIGN PATENT DOCUMENTS

| | | |
|---|---|---|
| GB | 2307562 A | 5/1997 |
| JP | 59-55418 | 3/1984 |
| JP | 1-242987 | 9/1989 |
| JP | 4-204289 | 7/1992 |
| JP | 5-19990 | 3/1993 |
| JP | 6-33095 | 4/1994 |
| JP | 7-159561 | 6/1995 |
| JP | 7-289706 | 11/1995 |

* cited by examiner

*Primary Examiner*—David Martin
*Assistant Examiner*—Michael L. Lindinger
(74) *Attorney, Agent, or Firm*—Dickstein Shapiro Morin & Oshinsky LLP

(57) ABSTRACT

A display includes a plurality of display arrays, such as a time display section (37), a chronological display section (38), and a chronological split display section (39). An upper or lower polarizer is provided with a light modulating section having a reflection type polarizer. To display only the time, the chronological display section (38) and the chronological split display section (39) are shielded by the light modulating section. For chronological display, the chronological display section (38) is lit, and the chronological split display (39) is displayed or shielded as required by a shutter function.

19 Claims, 18 Drawing Sheets

(a)

ELECTRONIC DEVICE WITH DISPLAY SECTION

BACKGROUND OF THE INVENTION

1. Field of the Invention

The present invention relates to an electronic device having a partially shieldable display section.

2. Description of the Related Art

Recently, the wearing or display of electronic devices, such as timepieces, as items of fashion has become very common, especially among the younger generation. To be successful, portable electronic devices must have a fashionable appearance and be obviously distinctive from other available products. That is, portable electronic devices are required to be unique.

With the above as a background, demand has grown for devices incorporating the ability to display or shield display sections using a shutter function upon demand to achieve versatile display choices for a varied intents and purposes. For example, the user of such a device may wish to use certain display elements only in a specific occasion, may wish to keep the display hidden most of the time to allow others to view certain elements only when the user wishes, may wish to use the display while keeping certain information confidential, or may wish to use the display in a variety of manners.

While it may be possible to realize the desired features through mechanical means, employment of mechanical shutters in a portable electronic device would lead to many disadvantages, such as a complicated structure, larger size, and significantly increased cost. Because of these disadvantages, the use of mechanical shutters has been avoided.

Therefore, the present invention has been conceived to overcome the above problems and aims to provide an inexpensive electronic device of a simple structure having a display section equipped with a unique shutter function.

SUMMARY OF THE INVENTION

In order to achieve the above object, according to the present invention, in an electronic device having a display section capable of displaying time, information, and so on, a display section having a plurality of display arrays including at least time display is provided with a light modulating section having a reflection type polarizer at above or below thereof for varying an optical axis of a transmitting light, so that at least a part of the display section can be shielded.

With the above, any display which may be unnecessary and/or may impair easy recognition of the displayed information is shielded for refinement of a display section of an electric device into a more easily viewed display section. Further, use of a reflection type polarizer attains neat appearance as a metal-like shielding. That is, with employment of a reflection type polarizer above or below the light modulating section, a part of the display section can be shielded. When a reflection type polarizer is used for one side of the polarizer, a shielded display section presents a mirror-like appearance, which can help maintain an agreeable state.

When the display section has both a hand display section and a digital display section, at least one of or a part of the display sections can be shielded by the light modulating section.

When the display section is a digital display section comprising a plurality of display arrays or a plurality of laminated display sections, at least one array or layer of the display sections can be shielded by the light modulating section. when one of the plurality of display arrays is for time display while the rest is for display of a time period (such as a chronological time), general information (such as a telephone number), or confidential information, either of the information display sections can be shielded.

When the display section includes display characters, such as numbers, letters, symbols, or the like, at least one of the display characters can be shielded by the light modulating section.

The display section can be partly shielded when a reflection type polarizer is arranged for either above or below the light modulating section. With a reflection type polarizer used for either above or below the light modulating section, the shielded display section presents mirror-like appearance so that a good-looking state can be maintained.

As described above, according to the present invention, there can be provided a unique and versatile display for an electronic device. The shutter mechanism has a simple and unique structure for low cost, which contributes to the ability to offer a wider variation of commodities.

In addition, there may be provided an electronic device having a display section, in the form of an LCD electronic watch having an information preparation means for preparing time information or the like, an LCD device for displaying the time information or the like, and a driving means for driving the LCD device. In such a device, an external switch for switching driving or not driving of display of the LCD device by the driving means is provided, and the LCD device may have at least one reflection type polarizer so that, of the segments of the LCD device, either a segment being driven by the driving means or a segment not being driven by the driving means presents a metal-like appearance.

Alternatively, a part of the liquid crystal display section, where the segment is not disposed, may present metal-like appearance.

In a further alternative, a part of the liquid crystal display section, where the segment is not disposed, may be transmissive.

Also, a control circuit may be provided for controlling a driving circuit, based on operation of an external switch, such that the LCD device displays the time information of the like.

The control circuit may control the driving circuit such that segments of the liquid crystal display section are sequentially driven, beginning with a segment at an endmost segment of the LCD device.

The segments of the LCD device may be divided into upper and lower groups so that the control circuits periodically controls the divided segments sequentially.

A frequency from the driving circuit for driving the segments may be gradually changed until the upper and lower segments are both driven before all segments are turned off.

As described above, according to the present invention, versatility can be enhanced for a display method for liquid crystal display of information such as a time.

BRIEF DESCRIPTION OF THE DRAWINGS

The above and other objects, features, and advantages of the present invention will become further apparent from the following description of the preferred embodiment taken in conjunction with the accompanying drawings wherein.

DESCRIPTION OF THE PREFERRED EMBODIMENTS

Figure 1:
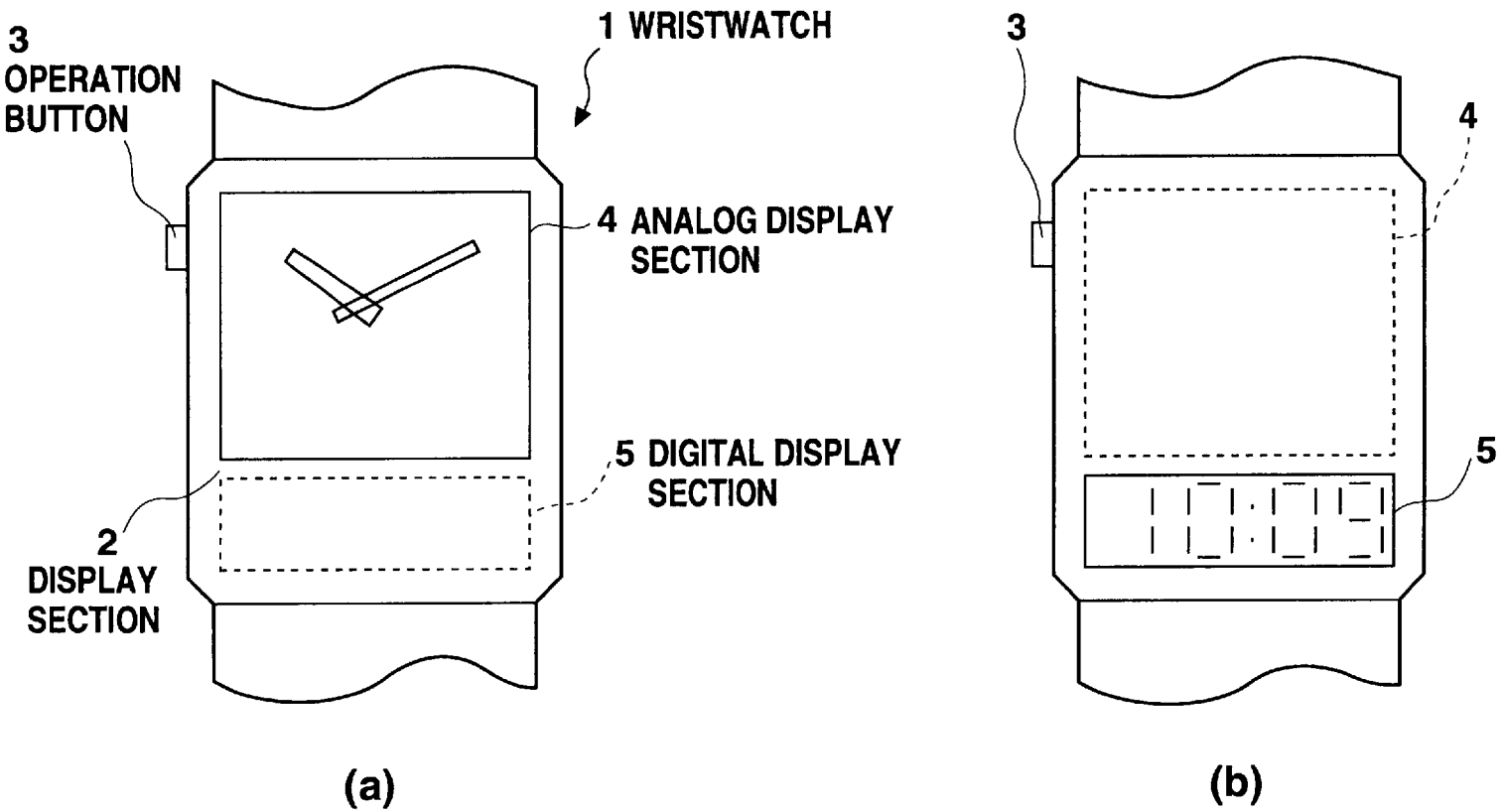
FIG. 1 is a plan view showing a wristwatch according to a first preferred embodiment of the present invention in which FIG. 1(*a*) shows a digital display section in a shielded state and FIG. 1(*b*) shows an analogue display in a shielded state.
Figure 2:
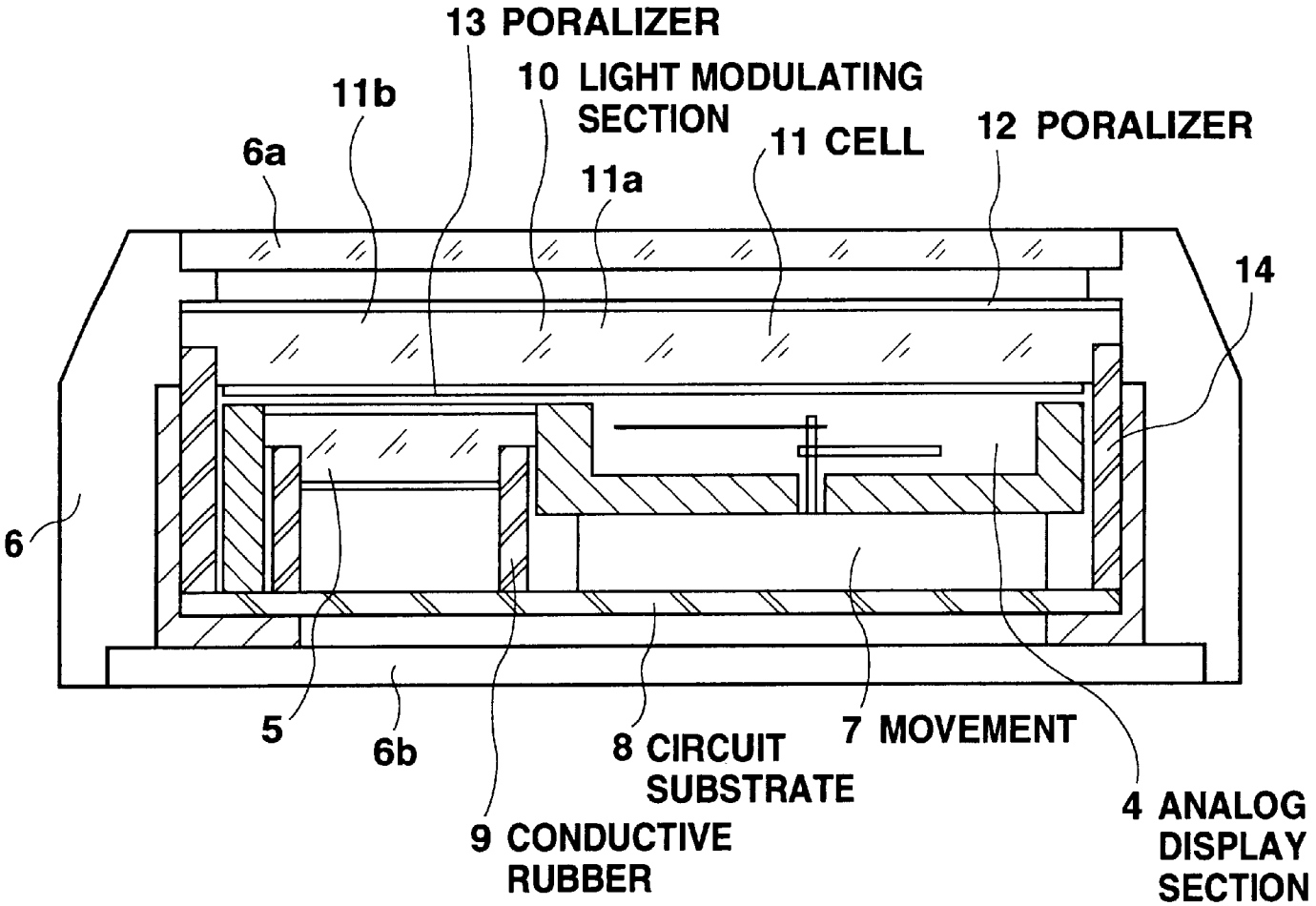
FIG. 2 is a cross sectional view showing major elements of the wristwatch shown in FIG. 1.
Figure 3:
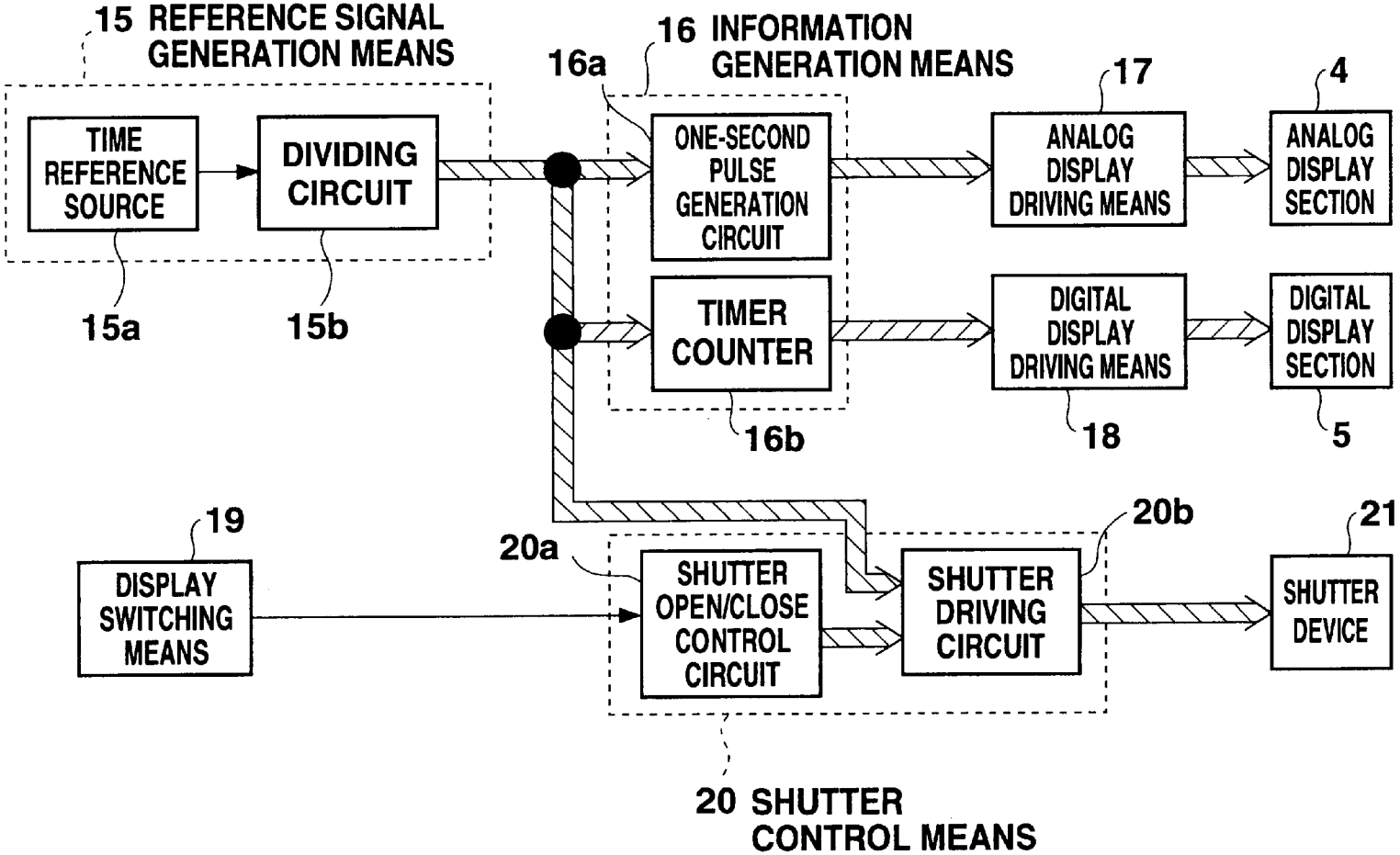
FIG. 3 is a schematic system diagram for the display shown in FIG. 1.

In the following, preferred embodiments of the present invention will be described in detail while referring to the accompanying drawings using an example device in the form of a wristwatch. FIG. 1 is a plan view showing a wristwatch according to a first preferred embodiment of the present invention. FIG. 2 is a cross sectional view showing major elements of the wristwatch of FIG. 1. FIG. 3 is a schematic system diagram for the displaying shown in FIG. 1. Initially, display configuration of the wristwatch will be described with reference to FIG. 1.

A wristwatch 1 comprises a display section 2 and an operation button 3 for display switching. The display section 2 has an analog display section 4 and a digital display section 5, which jointly operate to indicate a time, exemplified in the figure by nine minutes after ten o'clock.

The wristwatch 1 is equipped with both digital and analog display sections. However, the user may chose to have only one display visible while shielding the other because the combination of displays may actually make time recognition confusing, or simply because the user prefer either the analog or the digital display. For example, the analog display section 4 alone may be displayed, while the digital display section 5 is shielded with a shutter function (described later), as shown in FIG. 1(*a*). Alternatively, a user preferring digital display may have the digital display section 5 alone to be displayed, while shielding the analog display section 4, as shown in FIG. 1(*b*).

FIG. 2 is a cross sectional view of the wristwatch 1 of FIG. 1, including the shutter function. A frame 6 of the watch holds a glass sheet 6*a* and a rear cap 6*b*. Hands of the analog display section 4 are driven by a movement 7 and a circuit substrate 8. The digital display section 5, comprising liquid crystal cells, is driven for display by a signal supplied via a conductive rubber 9 from the circuit substrate 8.

A light modulating section 10 has a function for varying an optical axis of the light having entered from the glass 6*a* side, and a structure comprising a cell 11, an upper polarizer 12, and a lower polarizer 13, as shown in FIG. 1. The cell 11 comprises liquid crystal with a pattern 11*a* for shielding the analog display section 4 and a pattern 11*b* for shielding the digital display section 5.

At least one of the upper and lower polarizers 12, 13 comprises a reflection type polarizer. In this embodiment, the lower polarizer 13 is a reflection type polarizer, though the upper polarizer 13 or both of the upper and lower polarizers 12 and 13 may be a reflection type polarizer. The cell 11 receives a signal from the circuitry substrate 8 through the conductive rubber 14. The principle and structure of the light modulating section 10 will be described later in detail referring to FIG. 12.

FIG. 3 is a block diagram showing major elements of a circuitry structure. A reference signal generation means 15 comprises a time reference source 15*a* and a dividing circuit 15*b*. An information generation means 16 comprises a one-second pulse generation circuit 116*a*, driven in response to a signal from the dividing circuit 15*b*, and a time counter 16*b*. The drawing also shows an analog display driving means 17, a digital display driving means 18, and previously described analog display section 4 and digital display section 5.

A display switching means 19 operates jointly with the display switching operation button 3. A shutter control means 20 comprises a shutter open/close control circuit 20*a* and a shutter driving circuit 20*b* for receiving signals from the shutter open/close control circuit 20*a* and the dividing circuit 15*b*. A shutter device 21 includes the light modulating section 10.

Operation will next be described referring to FIG. 3. The dividing circuit 15*b* of the reference signal generation means 15 outputs a signal into the one-second pulse generation circuit 16*a* and the time counter 16*b* of the information generation means 16. The one-second pulse generation circuit 16*a* outputs a driving signal for the analog system, while the time counter 16*b* outputs a driving signal for the digital system.

That is, the one-second pulse generation circuit 16*a* generates and outputs a one-second pulse to the analog display driving means 17 for driving the hands of the analog display section 4 by a motor (not shown). The time counter 16*b* generates and outputs a one-second pulse to the digital display driving means 18 for driving the digital display section 5. The operation described thus far corresponds to that of a typical combination watch.

In a timepiece according to the present invention, in order to have only one of the analog and digital display sections 4, 5 displayed while shielding the other, the display switching operation button 3 should be pressed (see FIG. 1) to have the display switching means 19 to output a signal. In response to the signal, the shutter open/close control circuit 20*a* of the shutter control means 20 is activated, causing the shutter driving circuit 20*b* to open in synchronism with the shutter dividing circuit 15*b*, so that the shutter device 21 having the light modulating section 10 is opened or shut accordingly.

Therefore, to read the time from the analog display section 4, as shown in FIG. 1(*a*), the display switching operation button 3 is pressed to have the display switching means 19 to close the shutter for the digital display section 5. To show a digital display section only, on the other hand, as shown in FIG. 1(*b*), the display switching operation button 3 is pressed to have the display switching means 19 to close the shutter for the analog display section 4. Of course, the analog and digital display sections may both be displayed at the same time.

In the above, the display section with a closed shutter will display a mirror-like surface when a reflection type polarizer is used for the lower polarizer 13 of the light modulating section 10, presenting a unique overall appearance of the watch. Also, besides the total shielding of either the analog or digital display section 4, 5, as mentioned above, only a part of the numbers appearing in the digital display section 5 may be shielded by appropriately modifying the control program with the shutter open/close control circuit 20*a*.

Figure 4:
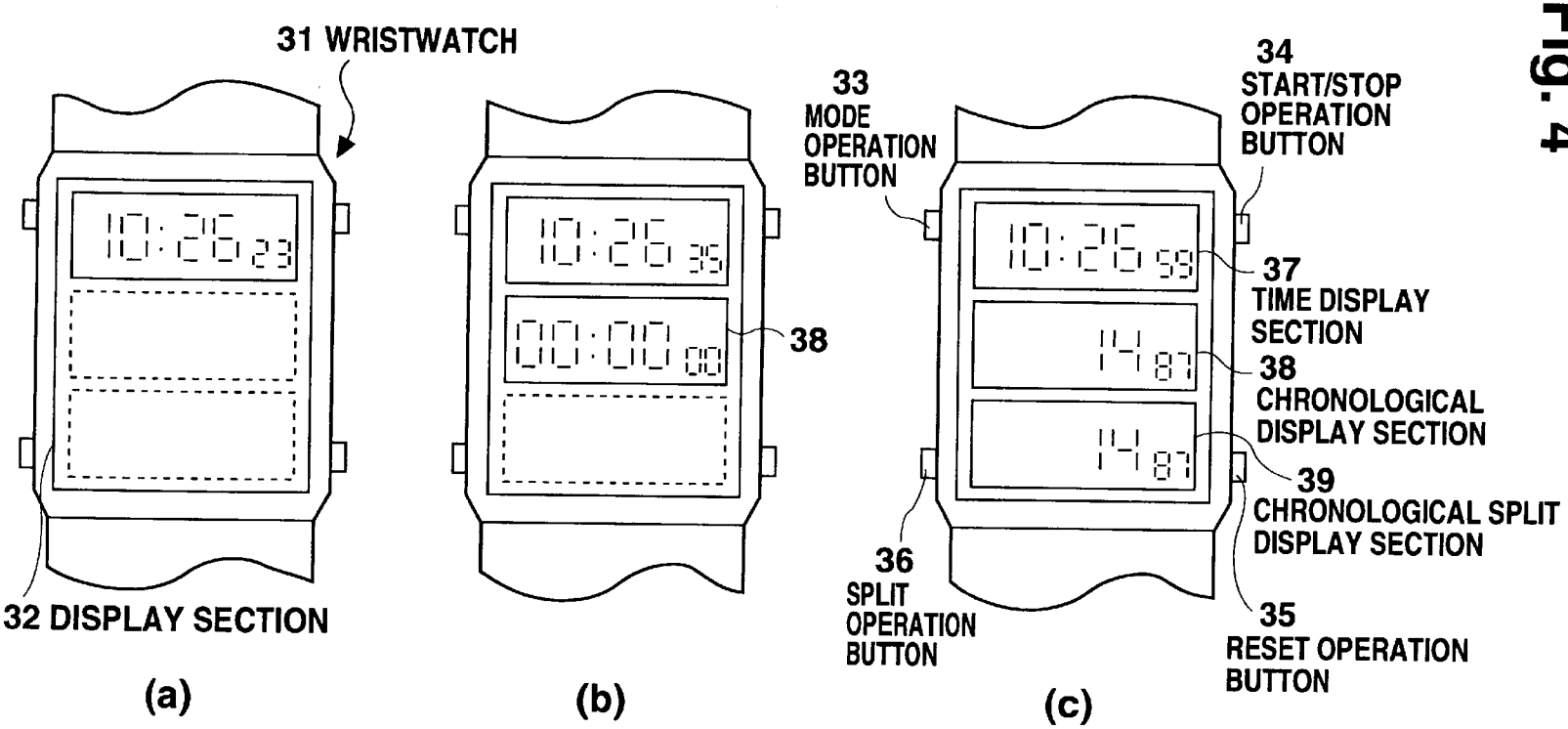
FIG. 4 is a plan view showing a wristwatch according to a second preferred embodiment of the present invention, in which FIG. 4(*a*) shows a chronological display section and chronological split display section both in a shielded state, FIG. 4(*b*) shows the chronological split display section in a shielded state, and FIG. 4(*c*) shows the chronological display section and the chronological split display section both in a fully displayed state.
Figure 5:
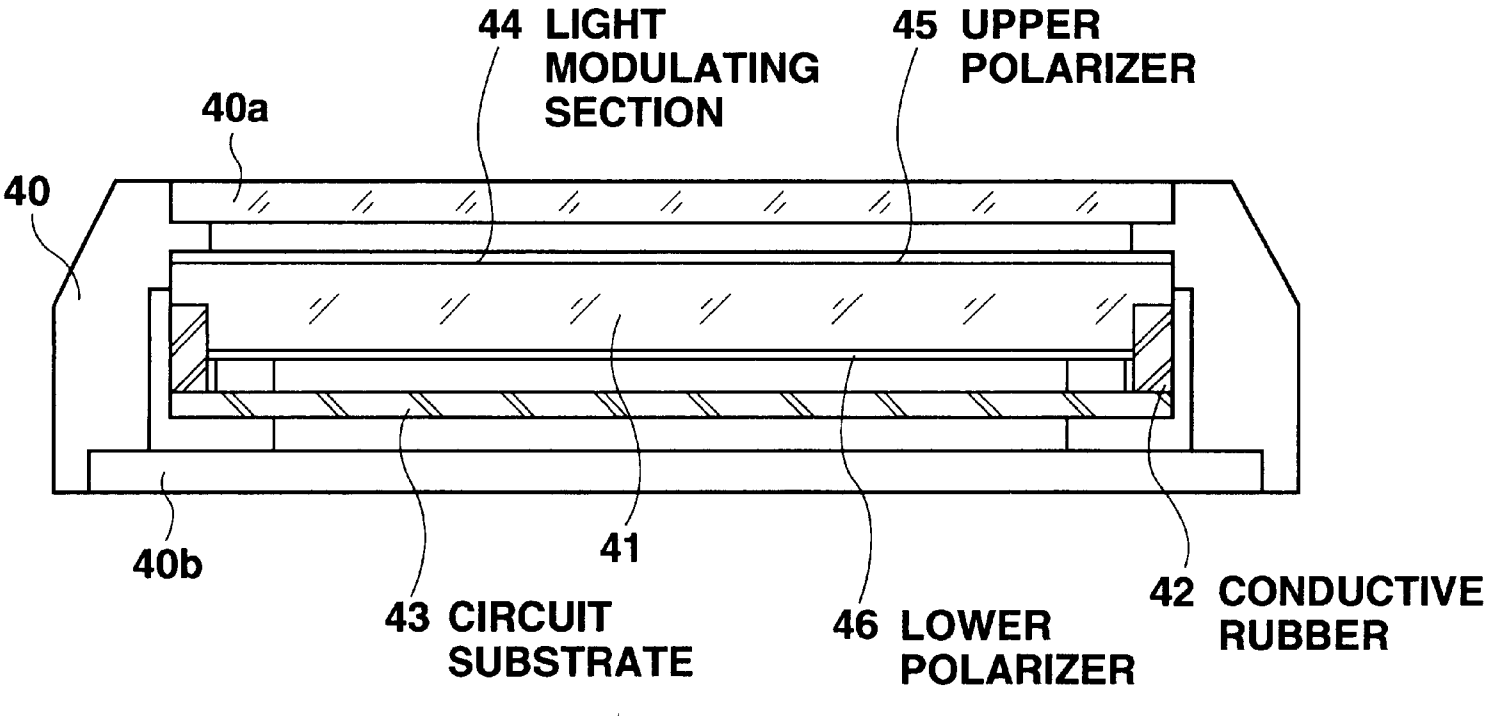
FIG. 5 is a cross sectional view showing major elements of the wristwatch shown in FIG. 4.
Figure 6:
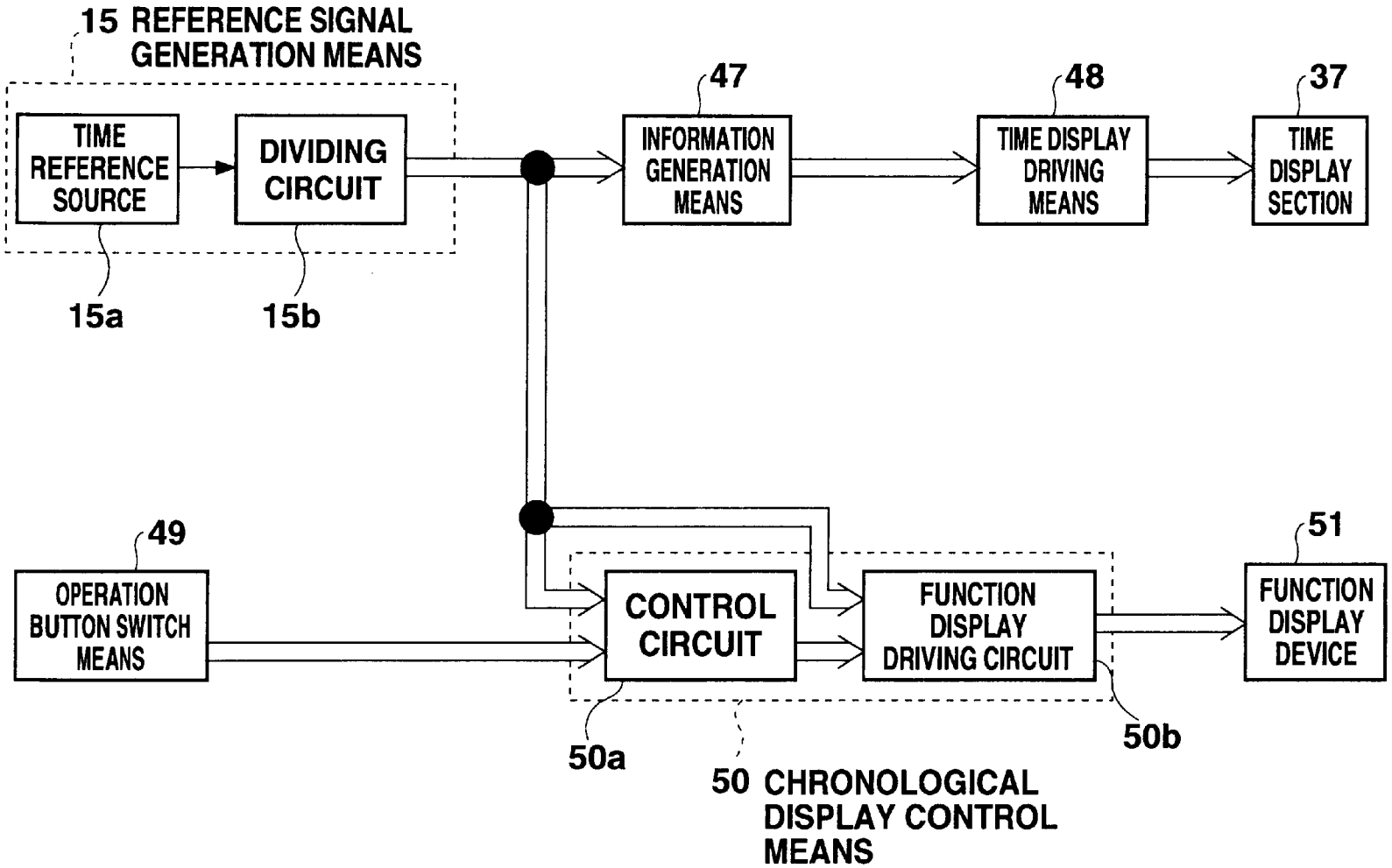
FIG. 6 is a schematic system diagram for the display shown in FIG. 4.

FIG. 4 is a plan view showing a wristwatch according to a second preferred embodiment of the present invention. FIG. 5 is a cross sectional view showing major elements of the watch of FIG. 4. FIG. 6 is a schematic system diagram for the display shown in FIG. 4. Referring to FIG. 4, a wristwatch 31 has a display section 32, a mode operation button 33, a start/stop operation button 34, a reset operation button 35, and a split operation button 36. The display section 32 includes a time display section 37 for displaying a time of day, a chronological display section 38, and a chronological split display section 39. FIG. 5 is a cross sectional diagram showing the watch of FIG. 4, including a shutter function. Framing 40 of the watch holds a glass sheet 40*a* and a rear cap 40*b*. The display section 32, comprising liquid crystal cells 41, is driven for display by a signal supplied via a conductive rubber 42 from the circuit substrate 43. Differing from the first embodiment, the liquid crystal cell 41 serves also as a light modulating section 44 so that displaying and a shielding function can both be attained using only a single liquid crystal cell layer. Specifically, the cell 41 works as the light modulation section 44 such that the whole digit pattern in the area shown enclosed by the broken line in FIG. 4(*a*) (all display segment electrode patterns of the liquid crystal cell) is turned off (no applied voltage state). With the above configuration, a shielded display state can be attained using a single liquid crystal layer.

The light modulating section 44 has a function for varying an optical axis of the light having entered from the glass 40*a* side, and a structure comprising an upper polarizer 45 and a lower polarizer 46. At least one of the upper and lower polarizers 45, 46 comprises a reflection type polarizer. In the example illustrating the present embodiment, the lower polarizer 46 is a reflection type polarizer. Display shown in a display region in the light modulating section 44 is shielded with no voltage applied to the display segment electrode pattern, and display, such as letters or numbers, can be seen with voltage applied to the display segment electrode pattern as a part of the segment electrode becomes transmissive.

FIG. 6 mainly shows a circuitry structure employable in the present embodiment. The reference signal generation means 15, comprising the time reference source 15*a* and the dividing circuit 15*b*, corresponds to that in the embodiment illustrated by FIG. 3. An information generation means 47, having received a signal from the dividing circuit 15*b*, outputs a signal to a time display driving means 48, which in turn outputs a signal to the time display section 38, which then displays a time.

An operation button switch means 49 operates cojointly with the respective buttons mentioned above, and is used mainly for chronological function display. A chronological display control means 50 comprises a control circuit 50*a* for receiving signals from the operation button switch means 49 and the dividing circuit 15*b*, and a function display driving circuit 50*b* for receiving signals from the control circuit 50*a* and the dividing circuit 15*b*. The drawing also shows a function display device 51, which includes a light modulating section 44.

Operation of this device will next be described referring to FIG. 6. Operation on the time display section 37 side is the same as that which has already been described in regards to FIG. 3, and will thus not be described again here. Instead, operation on the function display device 51 side will next be described.

The time display section 37 is continuously active and displays the present time of day, such as ten twenty-six and twenty-three seconds as shown in the figure. For a user usually wish to view only the time of day, the chronological display section 38 and the chronological split display section 39 are shielded by the light modulating section (described later), presenting a mirror-like surface, as shown in FIG. 4(*a*).

In order to use a chronological function, the mode operation button 33 is operated for selection of a chronological mode, upon which the control circuit 50*a* outputs a signal to the function display driving circuit 50*b* instructing it to open the shutter by the light modulating section 44 on the chronological display section 38 side. In response to the signal, the shutter which is shielding the chronological display section 38 of the function display device 51 is opened, upon which the watch is placed in a chronological function awaiting state. At the same time, the control circuit 50*a* receives a signal from the dividing circuit 15*b*. A value such as 0:0:0 is displayed on the chronological display section 38.

When the start/stop operation button 34 is then pressed, display of chronological is begun through operation of the operation button switch means 49 and the chronological display control means 50. In order to also display a split time in the lapse of a predetermined time after the start of displaying of the chronological time, the split operation button 36 should be operated. Thereupon, the shutter by the light modulating section 44, which is shielding the chronological split display section 39, is opened, and a split time is then displayed.

When the split time display disappears after operation of the split operation button 36 or because a predetermined time set on a timer has passed, the chronological split display section 39 is again shielded through operation of the chronological display control means 50 to a mirror-like surface, while the chronological display section 38 remains showing an elapsed time, as shown in FIG. 4(*b*). When the chronological function display becomes no longer necessary, pressing the mode operation button 33 will cause the chronological display section 38 to be shielded, which in turn presents mirror-like appearance.

Figure 7:
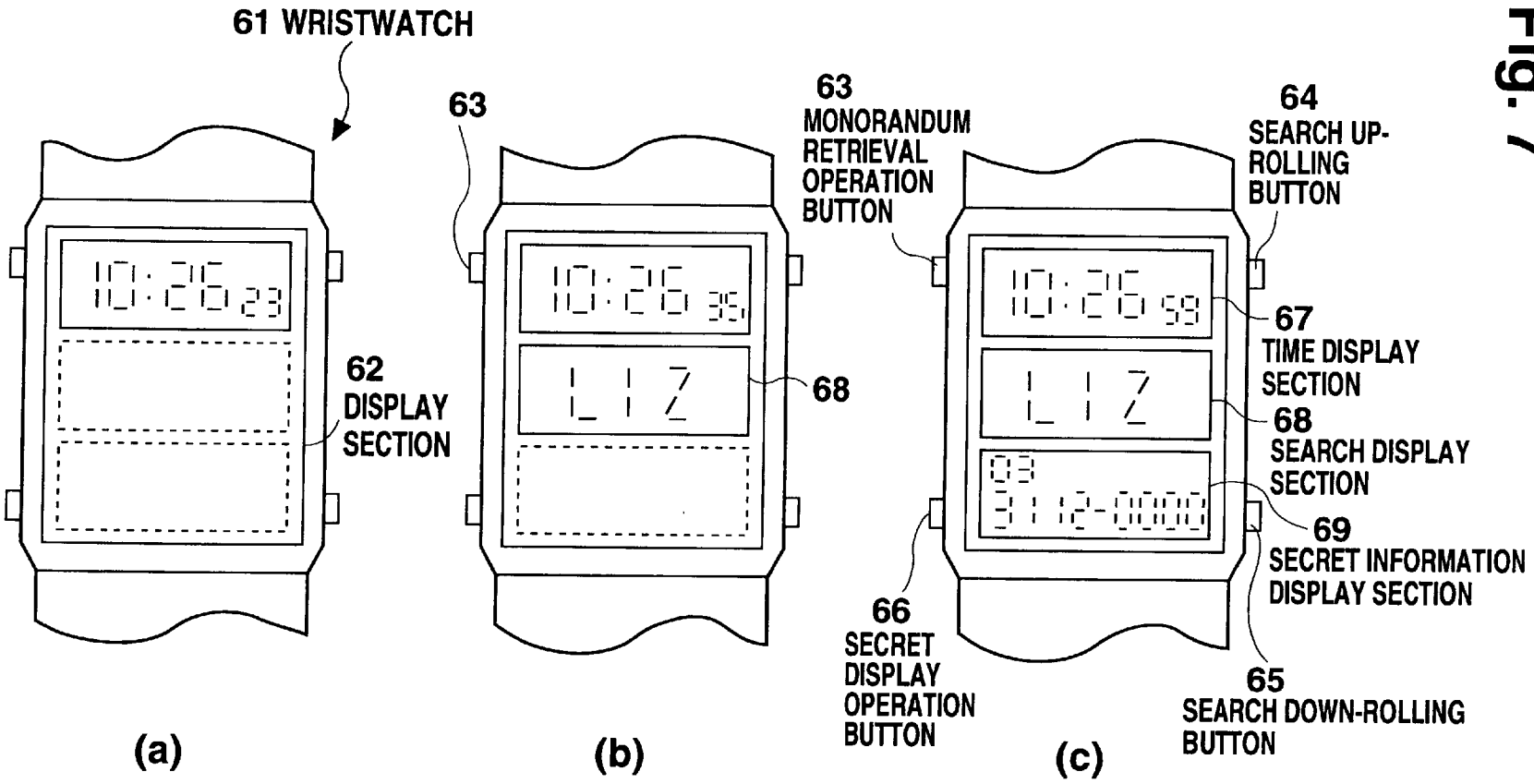
FIG. 7 is a plan view showing a wristwatch according to a third preferred embodiment of the present invention, in which FIG. 7(*a*) shows a search display and confidential information display both in a shielded state, FIG. 7(*b*) shows the confidential information display in a shielded state, and FIG. 7(*c*) shows the search display and the confidential information display both in a fully displayed state.
Figure 8:
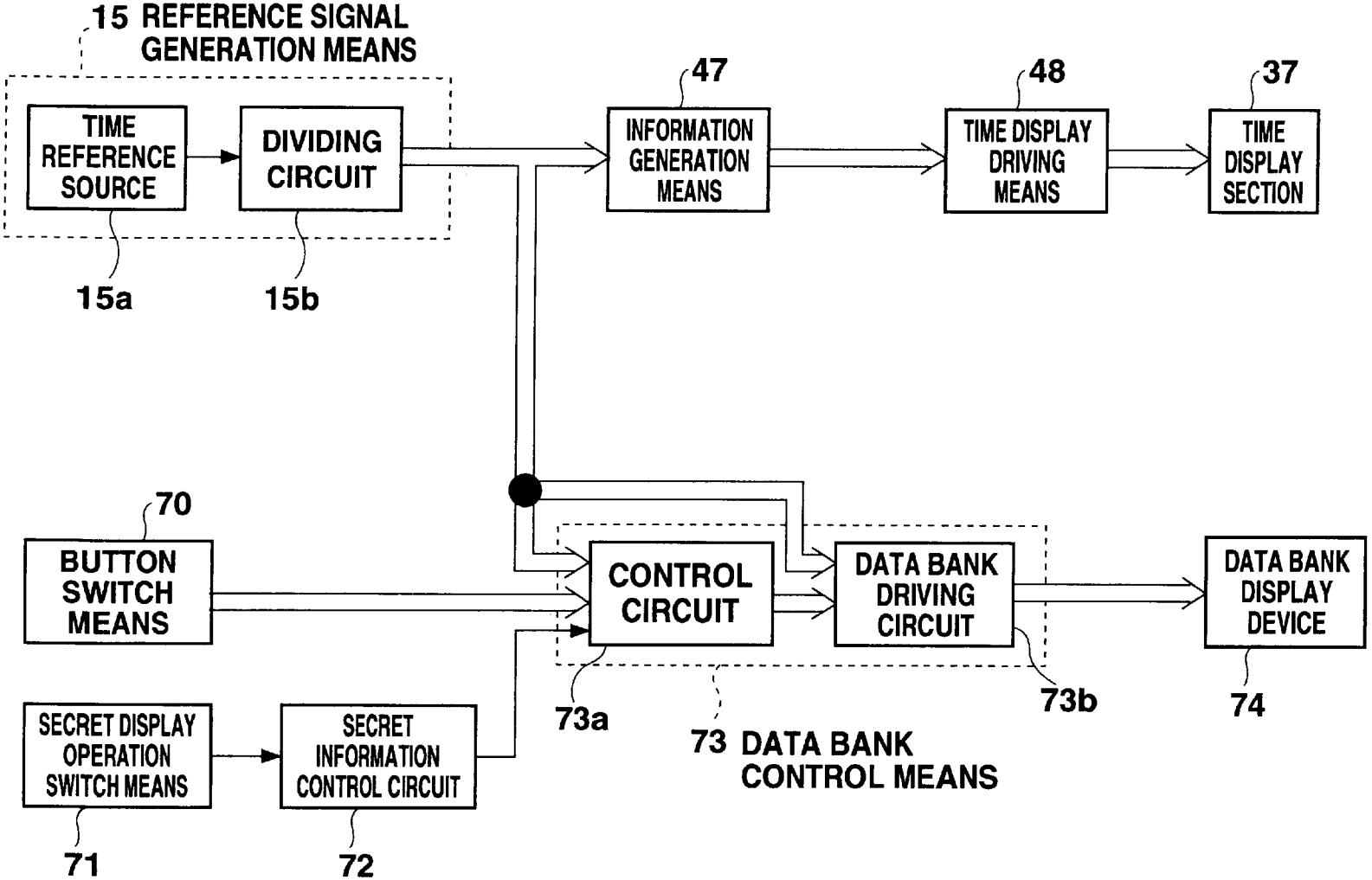
FIG. 8 is a schematic system diagram for the display shown in FIG. 7.

FIG. 7 is a plan view showing a wristwatch according to a third preferred embodiment of the present invention. FIG. 8 is a schematic system diagram for the displaying shown in FIG. 7. The wristwatch has a cross section with major elements similar to that shown in FIG. 5, that is, including a single liquid crystal cell layer. FIG. 7 shows an exemplary display of data bank as confidential information. The wristwatch 61 comprises a display section 62, a memorandum retrieval operation button 63, a search up-rolling button 64, a search down-rolling button 65, and a secret display operation button 66. The display section 62 includes a search display section 68 and a confidential information display section 69 as well as a time display section 67.

Referring to FIG. 8, time displaying operation is the same as that which has been described referring to FIG. 7, and is not described again here. An operation button switch means 70 controls operations of the respective buttons 63, 64, 65. A secret display operation switch means 71 controls operation of the secret display operation button 66. The diagram also shows a confidential information control circuit 72.

A data bank control means 73 comprises a control circuit 73*a* for receiving signals from the operation button switch means 70, the dividing circuit 15*b*, and the confidential information control circuit 72, and a data bank driving circuit 73*b* for receiving signals from the control circuit 73*a* and the dividing circuit 15*b*. The drawing also shows a data bank display device 74, which includes a light modulating section 44.

Referring to FIG. 8, operation for data bank display will be described. As shown in FIG. 7(*a*), time display is usually shown in the time display section 67. By operating the memorandum retrieval operation button 63, the button switch means 70 is caused to output a signal into the control circuit 73*a*. The control circuit 73*a* then outputs a signal to the data bank driving circuit 73*b* for the light modulating section 44 on the search display section 68 side to open the shutter, in response to which that shutter which is shielding the search display section 68 is opened.

Here, by operating the search scrolling buttons 64, 65, a desired name, e.g., "LIZ", is selected and displayed on the search display section 68 via the operation button switch means 70. The confidential information display section 69 is kept shielded while searching, presenting mirror-like appearance, until "LIZ", is found. Telephone numbers corresponding to respective names cannot be seen by others.

When the search is completed, pressing the secret display operation button 66 will cause the switch 71 to operate, and the shutter which is shielding the confidential information display section 69 is opened via the data bank control means 73 under control by the confidential information control circuit 72. This allows the user to read the telephone number for "LIZ". To finish the display, the buttons 66 and 63 are operated to shield the confidential information display section 69 and the search display section 68, respectively, to have them again present mirror-like appearance.

Figure 9:
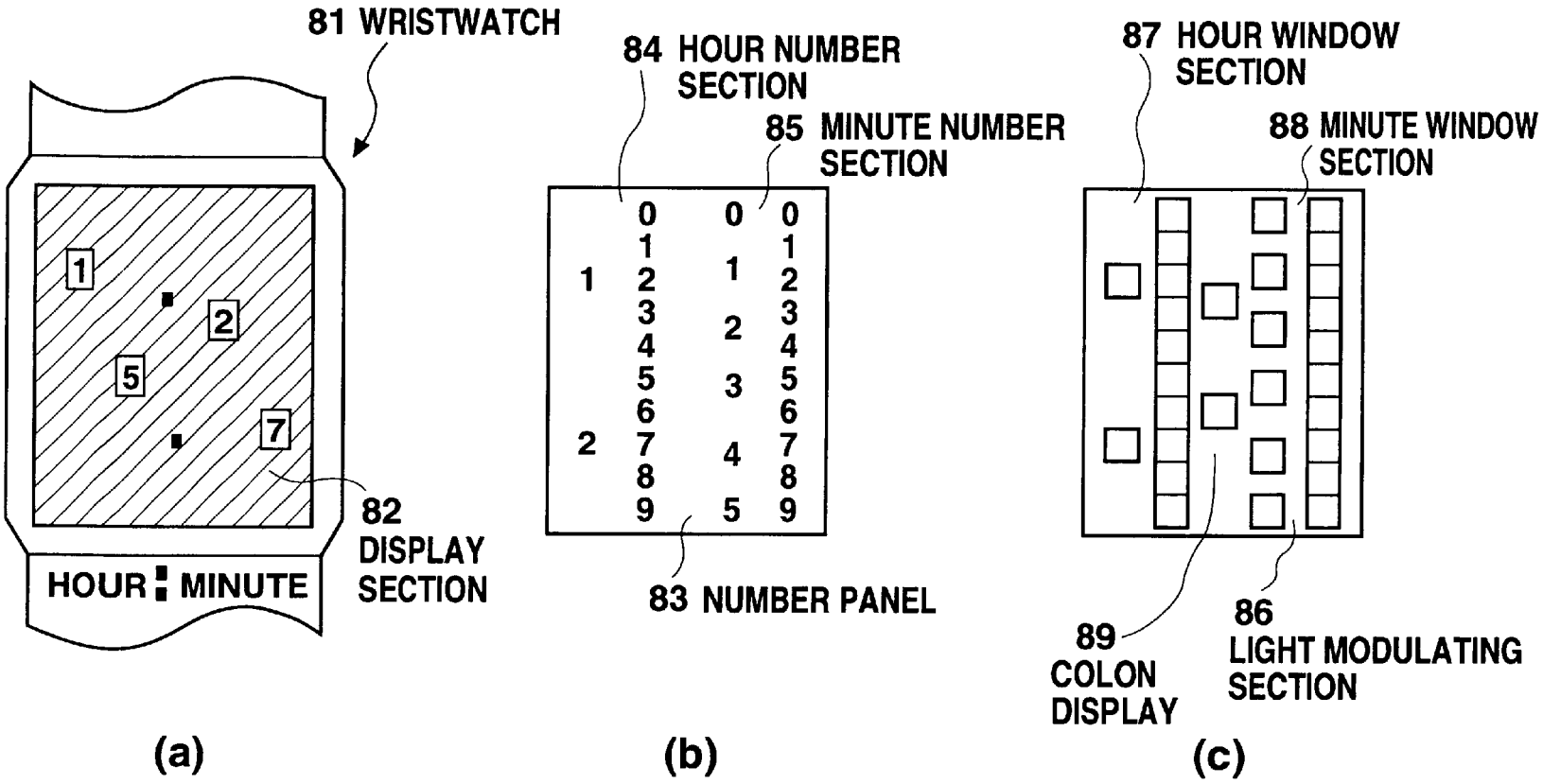
FIG. 9 is a plan view showing a wristwatch according to a fourth preferred embodiment of the present invention in which FIG. 9(*a*) shows display of time, FIG. 9(*b*) shows a number panel, and FIG. 9(*c*) shows windows on a light modulating section.
Figure 10:
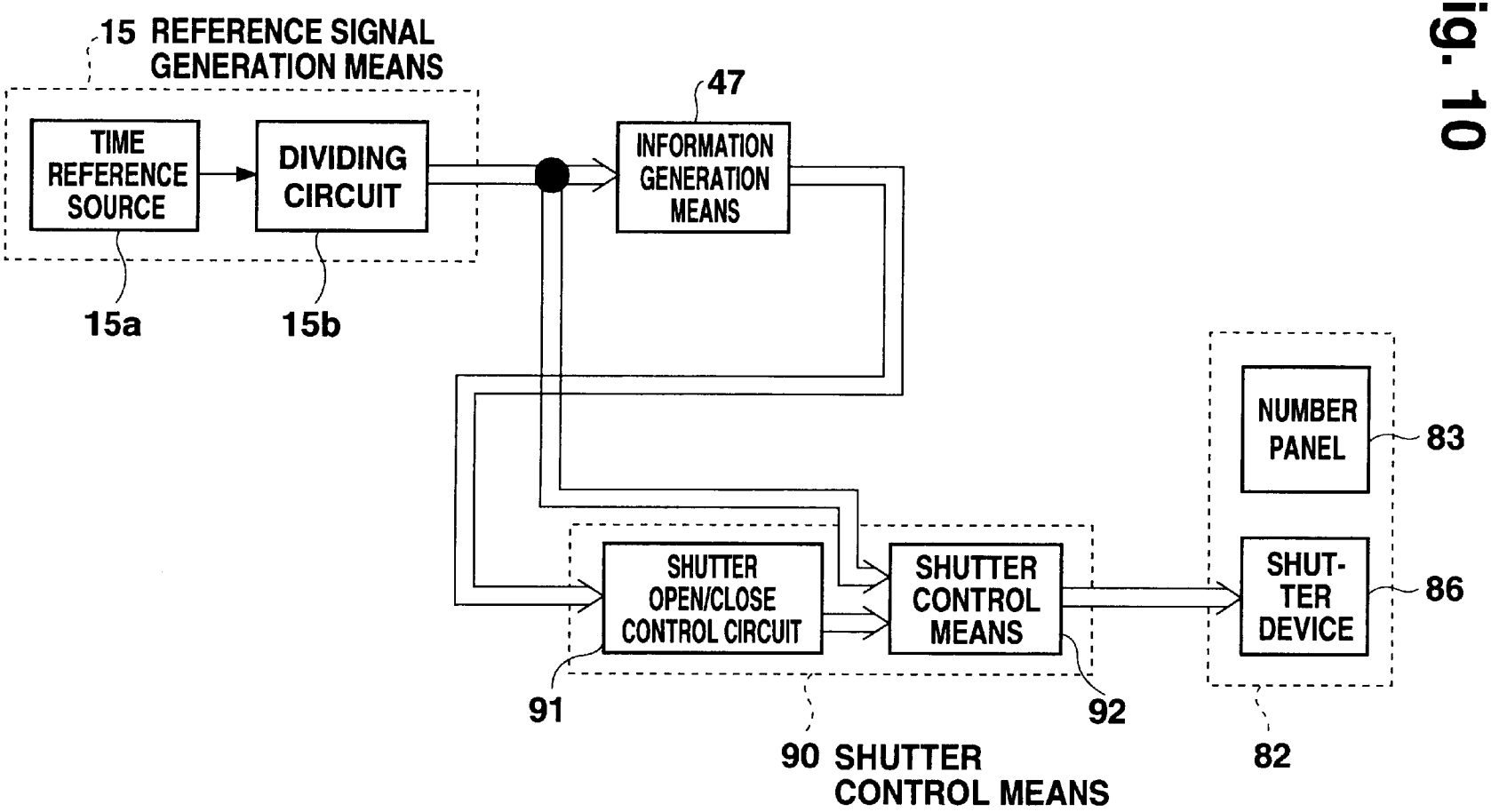
FIG. 10 is a schematic system diagram for the display shown in FIG. 9.

FIG. 9 is a plan view showing a wristwatch according to a fourth preferred embodiment of the present invention. FIG. 10 is a schematic system diagram for the displaying shown in FIG. 9. A panel with numbered described thereon, as shown in FIG. 9(*b*), is disposed under a liquid crystal cell as a light modulating section 86 according to a preferred embodiment other than this embodiment. FIG. 9(*b*) is a top view of a number panel as mentioned above. The number panel 83 includes an hour number section 84 and a minute number section 85, wherein numbers 1 and 2 and the numbers 0 through 5 are printed in the tens columns of the hour number section 84 and the minute number section 85, respectively, and the numbers 0 through 9 are printed in the unit columns of the hour number section 84 and the minute number section 85.

FIG. 9(*c*) is a top view of a light modulating section. The light modulating section 86 comprises two and ten hour windows 87 for the tens and unit columns, respectively, and six and ten minute windows 88 for the tens and unit columns, respectively, corresponding to the respective numbers on the number panel 83. These windows can be opened/closed. In addition, a colon display section 89 for indicating seconds is formed between the hour windows 87 and the minute windows 88. FIG. 9(*a*) is a plan view showing a wristwatch. In the wristwatch 81, the number panel 83 of FIG. 8(*b*) and the light modulating section 86 of FIG. 9(*c*) are arranged one on the other in this order on the rear cap between the glass sheet and the rear cap.

FIG. 10 is a schematic system circuit for driving the wristwatch 81. Respective means up to the information generation means 47 involved in the driving operation correspond to those in FIG. 8, and will therefore not described again here. A shutter control means 90 comprises a shutter open/close control circuit 91 for receiving a signal from the information generation means 47, and a shutter driving circuit 92 for receiving a signal from the shutter open/close control circuit 91 and the dividing circuit 15*b*.

Operation according to the fourth preferred embodiment will be described using an example when the current time, measured by the information generation means 47, is fifteen twenty-seven. With respect to that time, the shutter open/close control circuit 91 controls the shutter control means 92 such that the shutter device 86, or a light modulating section, opens windows corresponding to "1" for the tenth column and "5" for the unit column of the hour window 87 and those corresponding to "2" for the tenth column and "7" for the unit column of the minute window 88.

The colon display 89 formed on the light modulating section 86 blinks to indicate seconds. With the above arrangement, the numbers printed on the number panel 83, or an hour minute printed panel, can be seen through the respective windows open on the shutter device 86, and seconds can be known from the blinking colons. That is, the user can know the time as fifteen twenty-seven, as shown in the wristwatch 81 of FIG. 9(*a*). Here, second intervals are known by means of a flashing colon.

Figure 11:
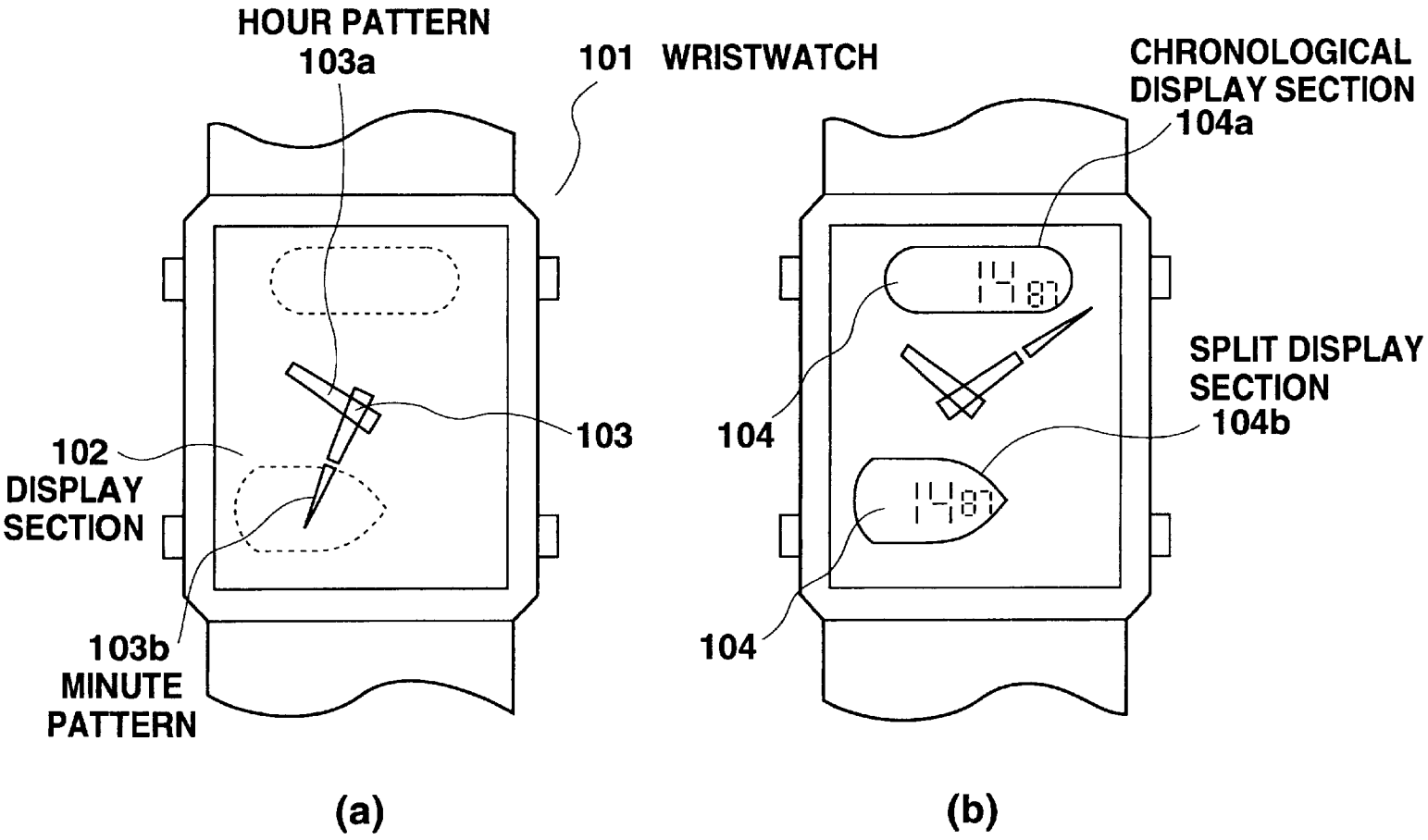
FIG. 11 is a plan view showing a wristwatch according to a fifth preferred embodiment of the present invention in which FIG. 11(*a*) shows the wristwatch not with a chronological function not in use and FIG. 11(*b*) shows the wristwatch with a chronological function in use.

FIG. 11 is a plan view showing a wristwatch according to a fifth preferred embodiment of the present invention. The wristwatch 101 of FIG. 11 may be achieved using a display section 102 of, for example, two liquid crystal cell layers. That is, the upper liquid crystal cell may be used to indicate the time by means of a hand pattern 103, while the lower liquid crystal cell may be used to indicate the time or a time period by means of a number display section 104. In this embodiment, a chronological time is indicated using the number display section 104.

As shown in FIG. 11(*a*), when the chronological function is not used, the number display 104 is shielded, similar to the second preferred embodiment, presenting mirror-like appearance using a reflection type polarizer employed for a light modulation section. In a chronological display state, as shown in FIG. 11(*b*), a split time is also displayed. When the split time is not displayed, the chronological display section 104*a* alone is shown with the split display section 104*b* being shielded, similar to the second preferred embodiment.

As an alternative of the embodiment of FIG. 11 (though not shown), when the hand pattern 103 overlaps the number display section 104 being lit, the minute pattern 103*b*, which overlaps the number display section 104, may be shielded while the hour pattern 103*a* alone is lit. The hour pattern 103*a*, or other display, can be similarly shielded, when it overlaps the number display section 104. One alternative of the fifth preferred embodiment may be a combination watch which has hour and minute hands of analog display, instead of the hour and minute patterns 103*a*, 103*b* of liquid crystal display.

Here, operation of a light modulating section comprising a reflection type polarizer, an absorption type polarizer, and a liquid crystal cell will be described. With a reflection type polarizer, a vibration panel (a reflection axis) orthogonal to a light transmission facilitation axis is a sheet for light reflection. With an absorption type polarizer, a vibration panel (an absorption axis) orthogonal to a light transmission facilitation axis is a sheet for light absorption. Therefore, when reflective and absorptive polarizers are arranged above and below the light modulating section comprising liquid crystal cell, a ratio between the transmission and reflection rates can be varied by rotating the light axis of the light having entered from the outside into the liquid crystal cell.

DBEF (trademark) optical film manufacture by Sumitomo 3M is one commercially available material suitable for a reflection type polarizer. A combination of a metal grid type polarizer (a metal grid of 0.2 $\mu$m pitch formed on a glass sheet), liquid crystal, and a phase difference panel can also realize such a panel.

That is, when the respective polarizers are arranged such that their transmission facilitation axes are set orthogonal to each other (in other words, the reflection axis of the reflection type polarizer and the absorption axis of the absorption type polarizer are set orthogonal to each other), the light having entered the light modulating section is reflected, presenting a metal-like reflection surface.

On the other hand, when the transmission facilitation axes of the reflection type and absorption type polarizers are arranged in parallel to each other (in other words, the reflection axis of the reflection type polarizer and the absorption axis of the absorption type polarizer are set in parallel to each other), the light having entered the light modulating section passes therethrough.

This will be described in further detail referring to FIG. 12.

Figure 12:
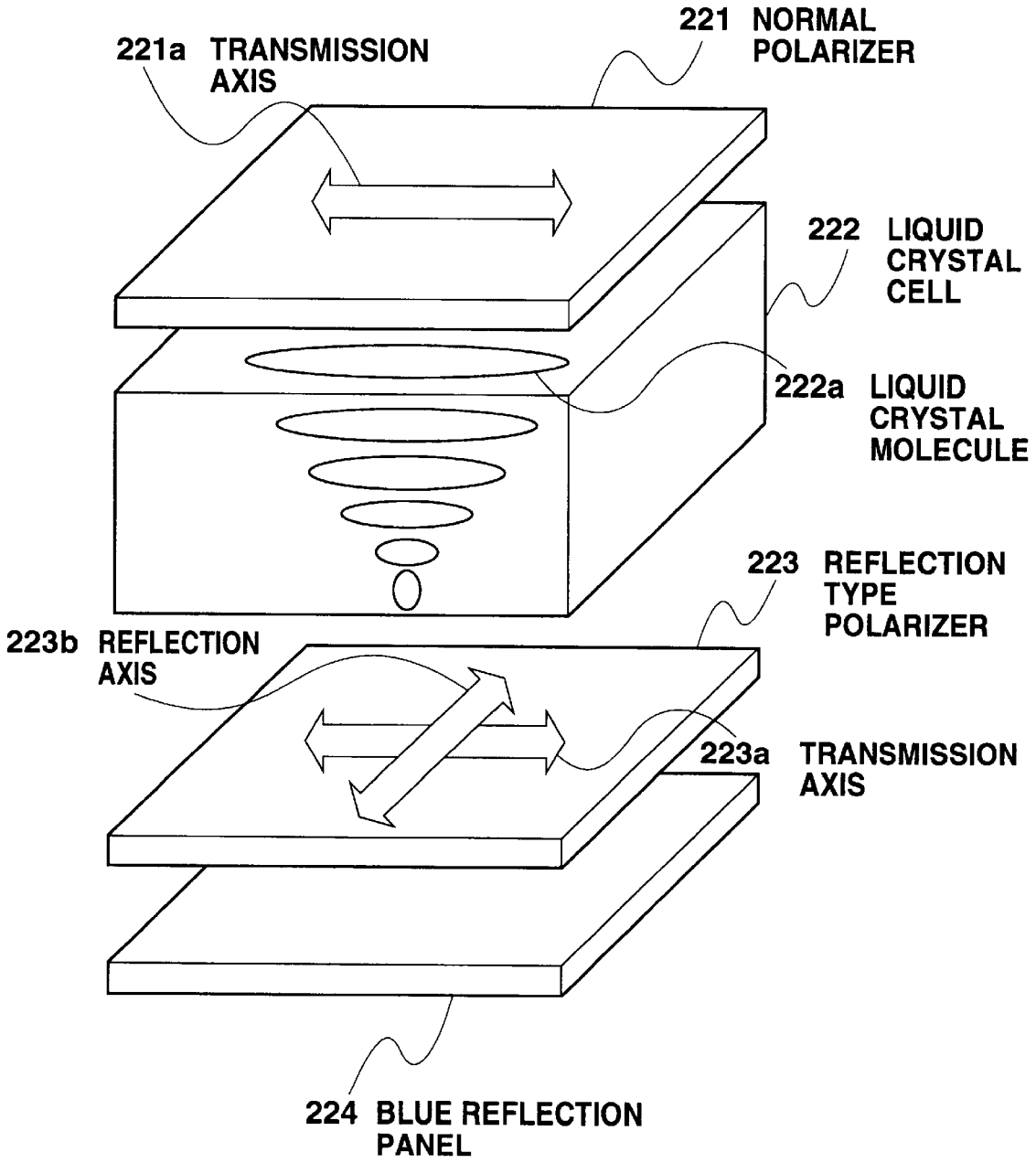
FIG. 12 is an exploded perspective view showing an LCD device usable in a preferred embodiment of the present invention.

FIG. 12 is a cross sectional view showing an LCD device using a reflection type polarizer.

A typical polarizer 221 (hereinafter referred to as a normal polarizer) has a transmission axis in the direction 221*a*. Liquid crystal molecules 222*a* are arranged spirally in the liquid crystal cell, as shown in FIG. 12.

When a voltage is applied, the liquid crystal molecules 222*a* of the liquid crystal cell 222 change their vertical orientation.

A reflection type polarizer 223 has a transmission axis 223*a* and a reflection axis 223*b*.

A blue reflection panel 224 reflects received light with a blue wavelength.

In a normal state as shown in FIG. 12, when light enters the polarizer 221 from thereabove, only the portion thereof in the direction of the transmission axis 221*a* reaches the liquid crystal cell 222, with the rest being absorbed by the normal polarizer 221.

The light having reached the liquid crystal cell 222 is rotated by 90 degrees by the liquid crystal molecules 222*a* before reaching the reflection type polarizer 223.

In the reflection type polarizer 223, as the direction of the reflection axis 223*b* thereof is coincided with that of the received light, the received light is reflected and reaches the liquid crystal cell 222.

The liquid crystal molecules 222*a* of the liquid crystal cell 222 again rotates the light by 90 degrees, so that the rotated light reaches the normal polarizer 221 in the same direction as that of transmission axis 221*a* of the normal polarizer 221.

As a result, the received light is reflected intact, which causes the entire liquid crystal device to have a mirror-like (hereinafter referred to as metal-like) appearance when viewed from thereabove.

However, when a voltage is applied to the liquid crystal cell 222, the liquid crystal molecule 222*a* of the liquid crystal cell 222 rise vertically. Therefore, the light having entered via the upper surface of the device proceeds through the normal polarizer 221 only in the direction of the transmission axis 221*a*, reaching intact the reflection type polarizer 223. The reached light further proceeds through the reflection type polarizer 223 as it directs in the same direction as that of the transmission axis 223*a* of the reflection type polarizer 223 until it reaches the blue reflection panel 224 and is then reflected as blue light.

The reflected blue light proceeds intact through the liquid crystal cell 222 and then the polarizer 221.

Therefore, the light appears blue in this case.

Figure 14:
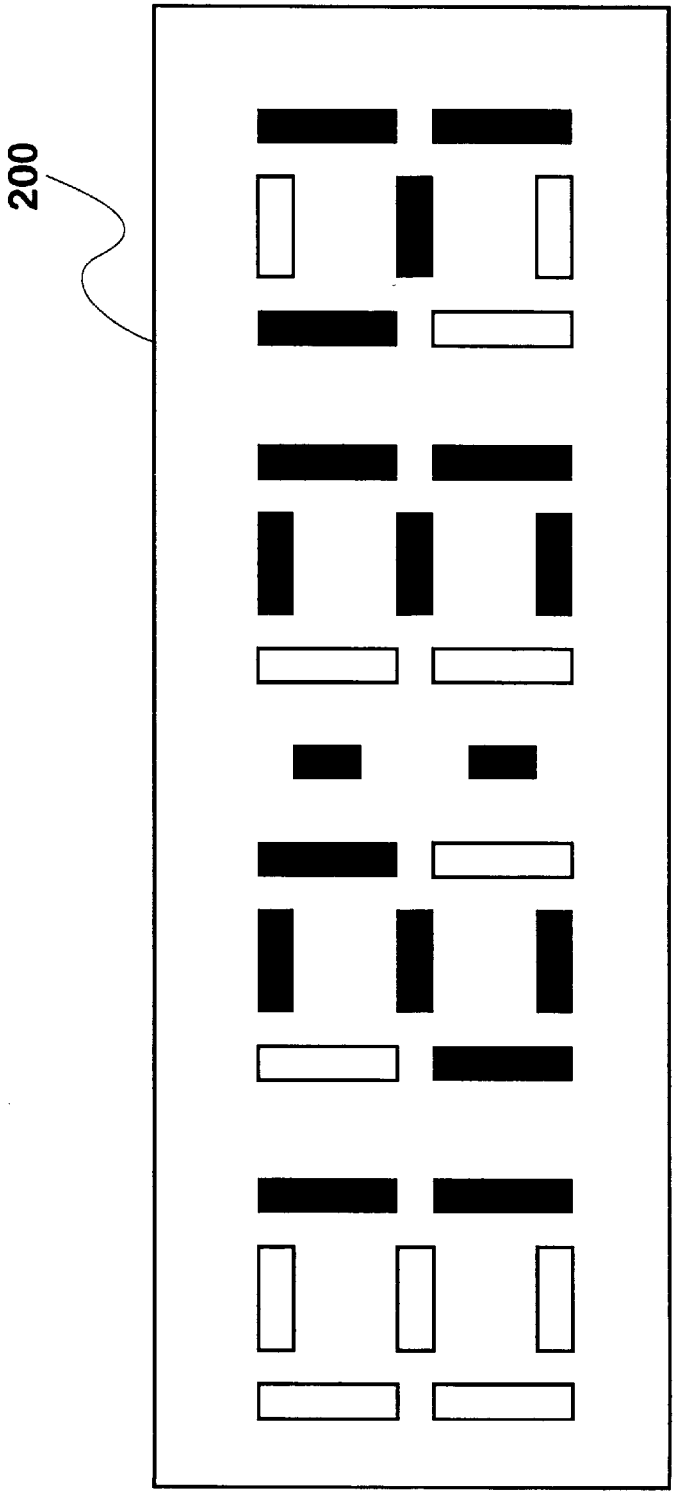
FIG. 14 is a plan view showing an LCD according to the sixth preferred embodiment of the present invention.

That is, when the time is displayed using the above LCD device, only the black parts in FIG. 14 appear blue, with other segment electrode patterns as well as the background 200 appear metal-like.

A sixth preferred embodiment of the present invention will be described, referring to FIG. 13, wherein the present invention is realized in the form of an electronic watch with LCD display.

The drawing shows an oscillation circuit 301 for outputting a reference signal, a dividing circuit 302 for dividing a reference signal, a time signal preparation circuit 303 for outputting a time signal, a driving circuit 304 for driving a liquid crystal device, and a liquid crystal device 305 for showing a time.

The drawing additionally shows an external switch 306 and a control circuit 307 for controlling the driving circuit 304 in response to operation of the external switch 306.

Operation of the sixth preferred embodiment will be described referring to FIGS. 13 and 15, using an example wherein the time of day is twelve thirty-four.

The time signal preparation circuit 303 prepares a time signal utilizing a dividing signal from the dividing circuit 302, and sends it to the driving circuit 304. The driving circuit 304 prepares a driving signal for driving a segment, based on the time signal. However, when the external switch 306 is not operated, the LCD device 305 displays nothing under control by the control circuit 307 so as not to generate any driving signal.

Therefore, the LCD device 305 continuously appears metal-like.

Figure 15:
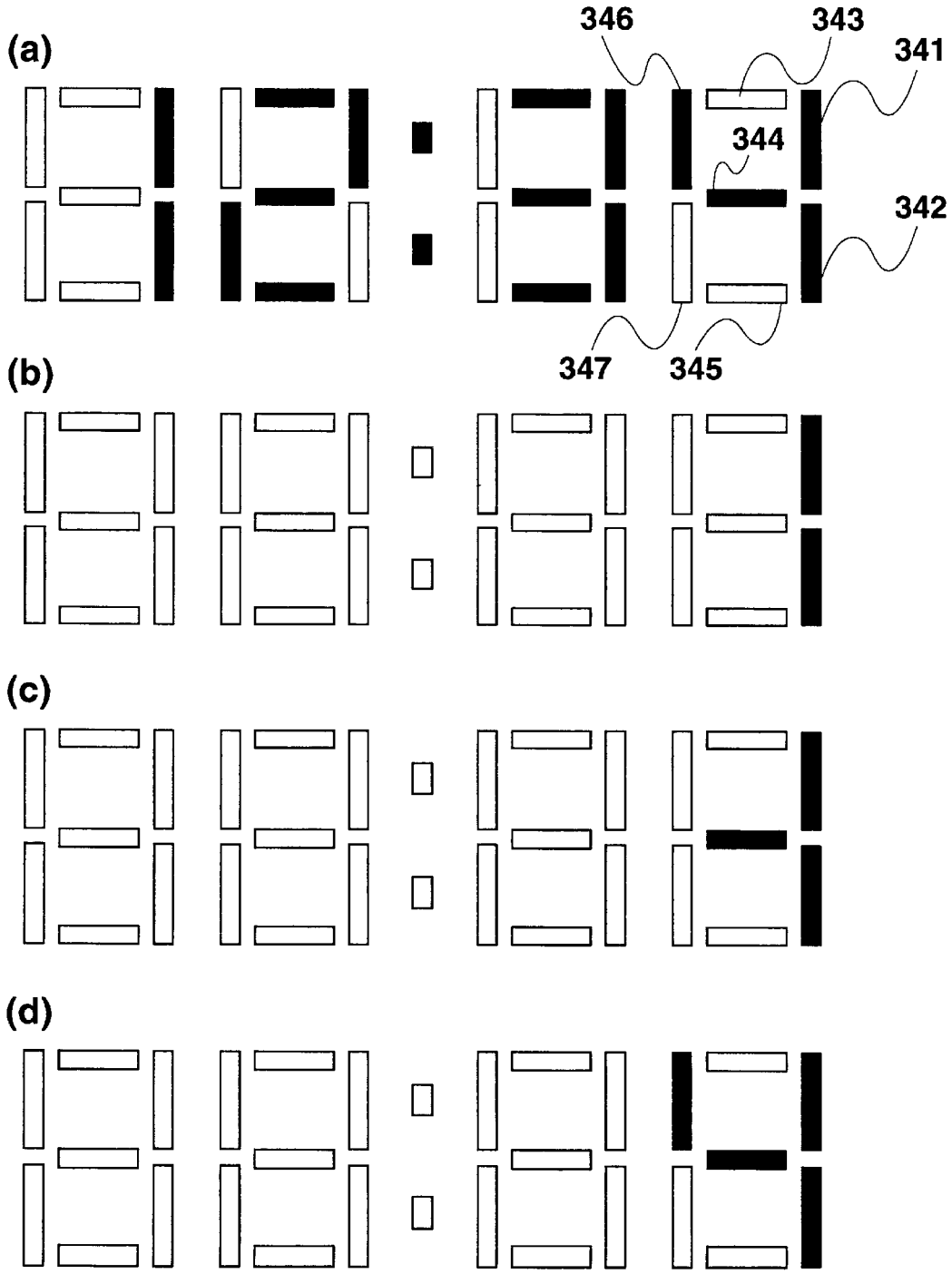
FIG. 15 is a plan view for explaining a display state of an LCD according to the sixth preferred embodiment of the present invention.

Here, when the user wishes to know a time and operates the external switch 306, the control circuit 307 controls the driving circuit 304 so as to validate the segments 341, 342, as shown in FIG. 15.

Therefore, a voltage is resultantly applied to the segments 341, 342, as shown in FIG. 15(*b*), which thereupon turn appear blue.

After 0.25 seconds, the control circuit 307 validates the segments 343, 344, 345. However, as the driving circuit 304 supplies a driving signal only to the segment 344, the segment 344 alone becomes blue with the other two remaining in metal-like appearance, as shown in FIG. 15(*c*).

After another 0.25 seconds, the control circuit 307 validates the segments 346, 347. However, as the driving circuit 304 supplies a driving signal only to the segment 346, the segment 346 alone becomes blue with the other two remaining in metal-like appearance, as shown in FIG. 15(*d*).

In this manner, numerals for time indication are gradually displayed from the smallest time unit as if a metal-like shutter were gradually opened, revealing the underlying numbers for time. After the elapse of a predetermined time (e.g., 10 seconds) after all required segments for the time indication have been displayed, the control circuit 307 controls the driving circuit 304 so as to top outputting of a driving signal, so that the display returns to its original metal-like appearance.

A seventh preferred embodiment of the present invention will be described referring to FIGS. 13 and 16.

Figure 13:
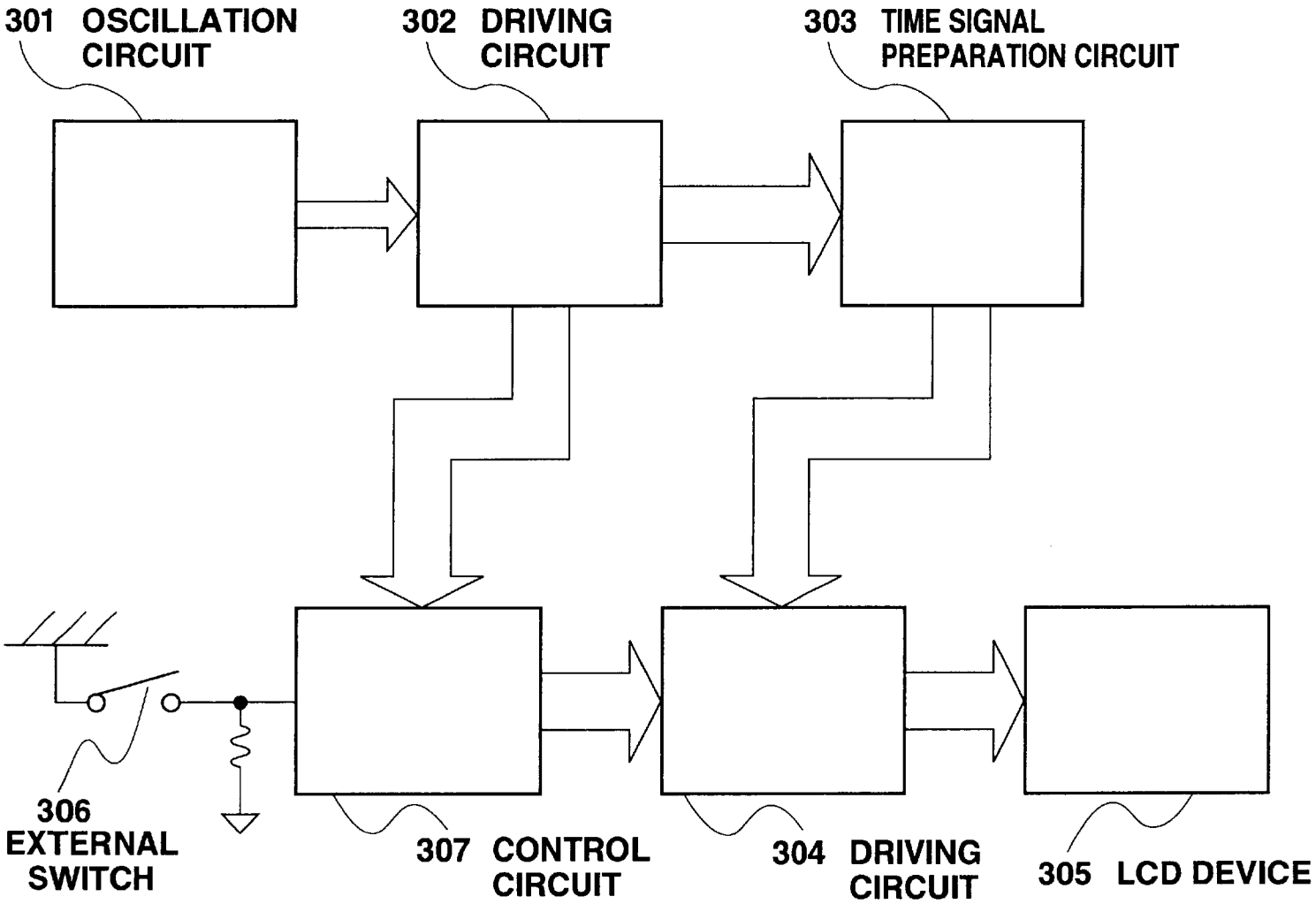
FIG. 13 is a circuitry block diagram showing an LCD electronic watch according to the sixth, seventh, and eighth preferred embodiments of the present invention.

A circuit block diagram for the LCD electronic watch in the seventh preferred embodiment is the same as that referred to in the sixth preferred embodiment, or that shown in FIG. 13.

The watch in the seventh preferred embodiment usually remains as in the sixth preferred embodiment.

Figure 16:
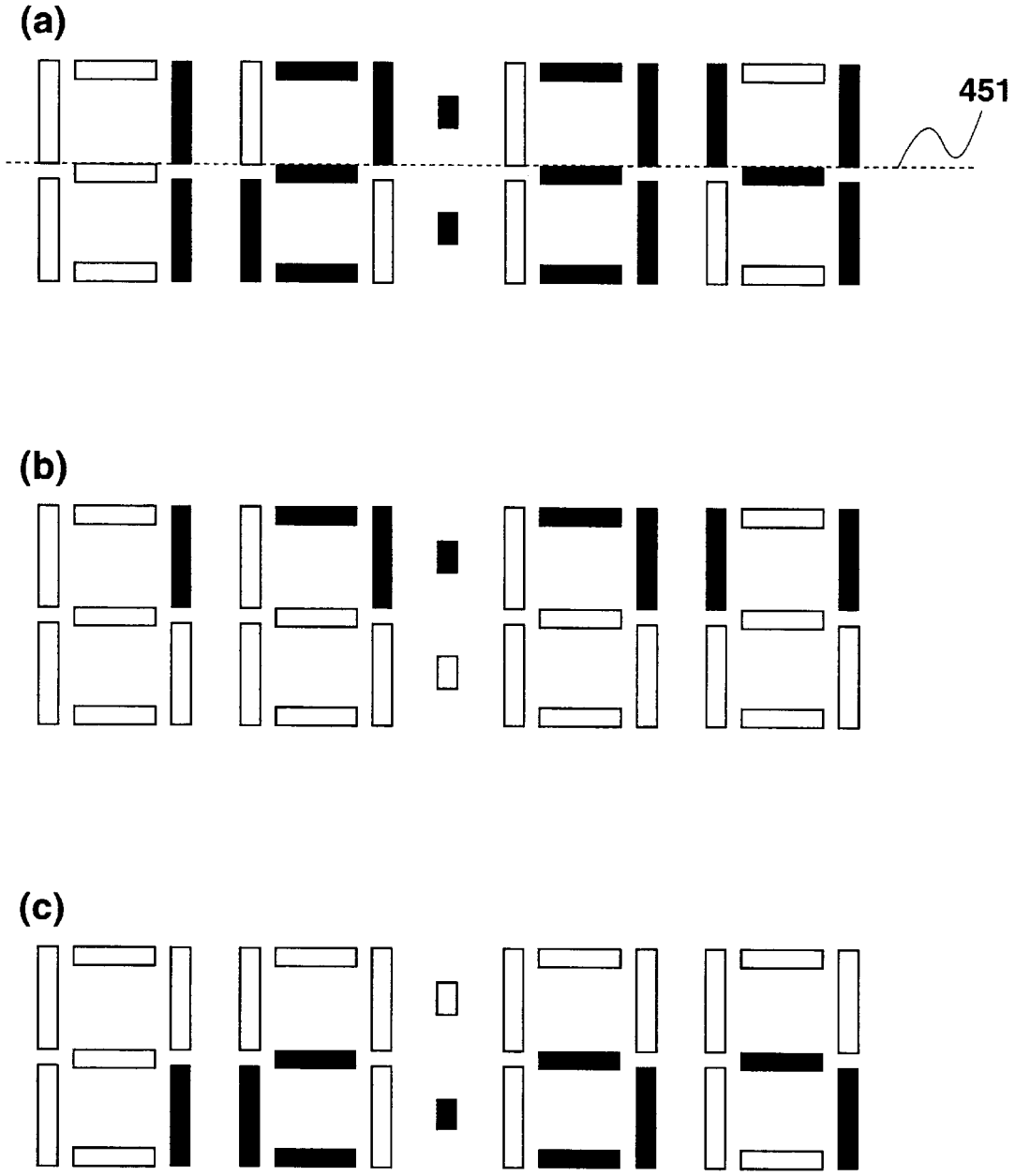
FIG. 16 is a plan view for explaining a display state of an LCD according to the seventh preferred embodiment of the present invention.

When the external switch 306 is once activated for time display, the control circuit 307 validates the upper half of the segments, those above the broken line in FIG. 16(*a*), whereby the LCD device 305 appears as is shown in FIG. 16(*b*). Subsequently, the control circuit 307 invalidates the upper half of the segments in FIG. 16(*a*), and simultaneously validates the lower half thereof, whereby the LCD device 305 appears as is shown in FIG. 16(*c*).

The above operation is carried out periodically as predetermined, which enables time displaying in a manner similar to that by a rotary-type display device, such as a display board installed in an airport or the like. After a predetermined time (e.g., five seconds), the upper and lower segments are both validated to indicate the time.

After a further predetermined time (e.g., ten seconds), the control circuit 307 controls the driving circuit 304 so as to stop outputting of a driving signal. Thereupon, the watch returns to present its original metal-like appearance.

It should be noted that the present invention is not limited to the above described seventh preferred embodiment. A displaying manner similar to that for a rotary-type display device can be achieved through modification in which a period of time for the upper and lower segments to blink is set to be gradually reduced.

A modified seventh preferred embodiment in which a blinking frequency for the display device is gradually lowered will be described as an eighth preferred embodiment with reference to FIGS. 17 and 18.

Figure 17:
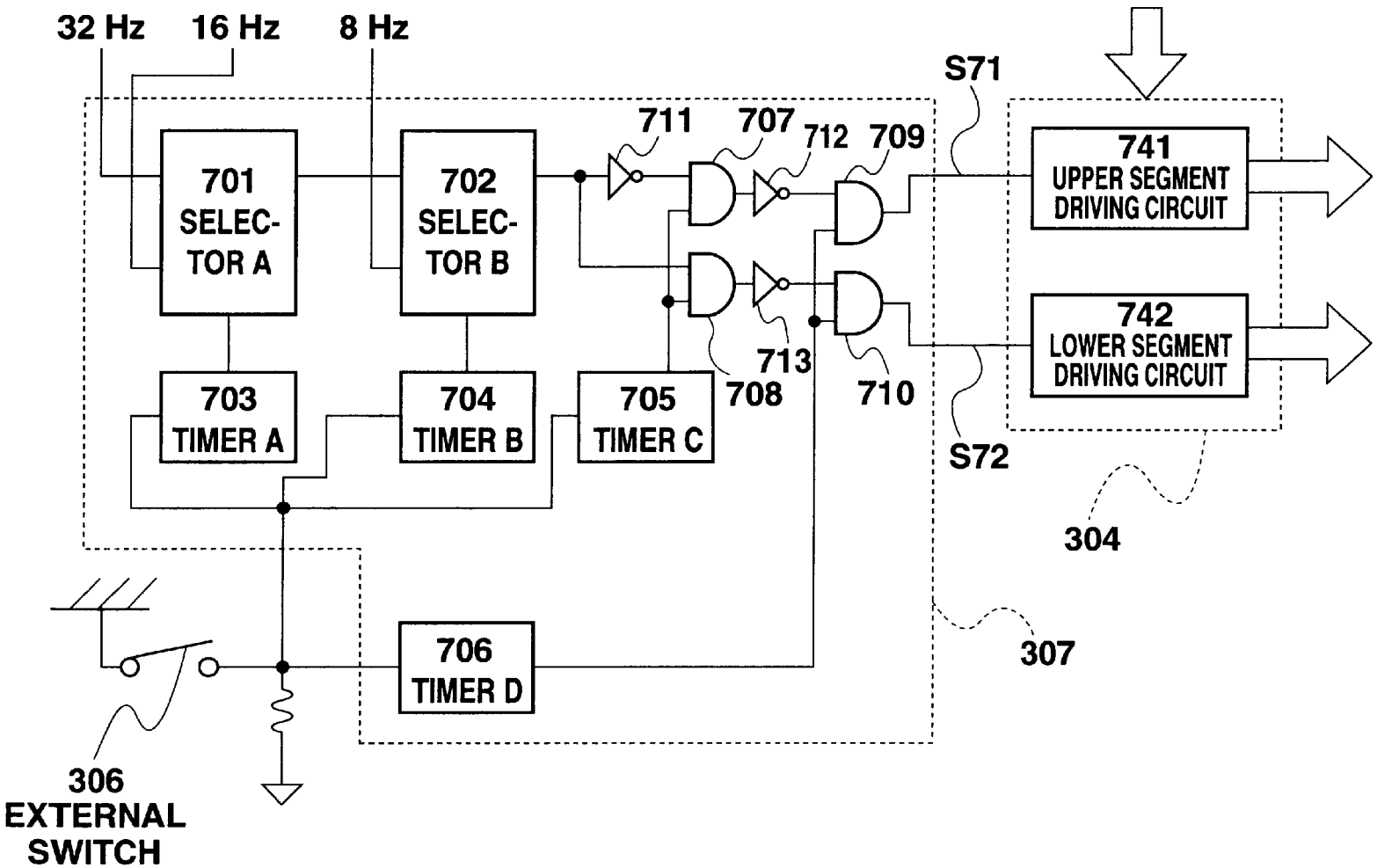
FIG. 17 is a circuitry block diagram according to the eighth preferred embodiment of the present invention.
Figure 18:
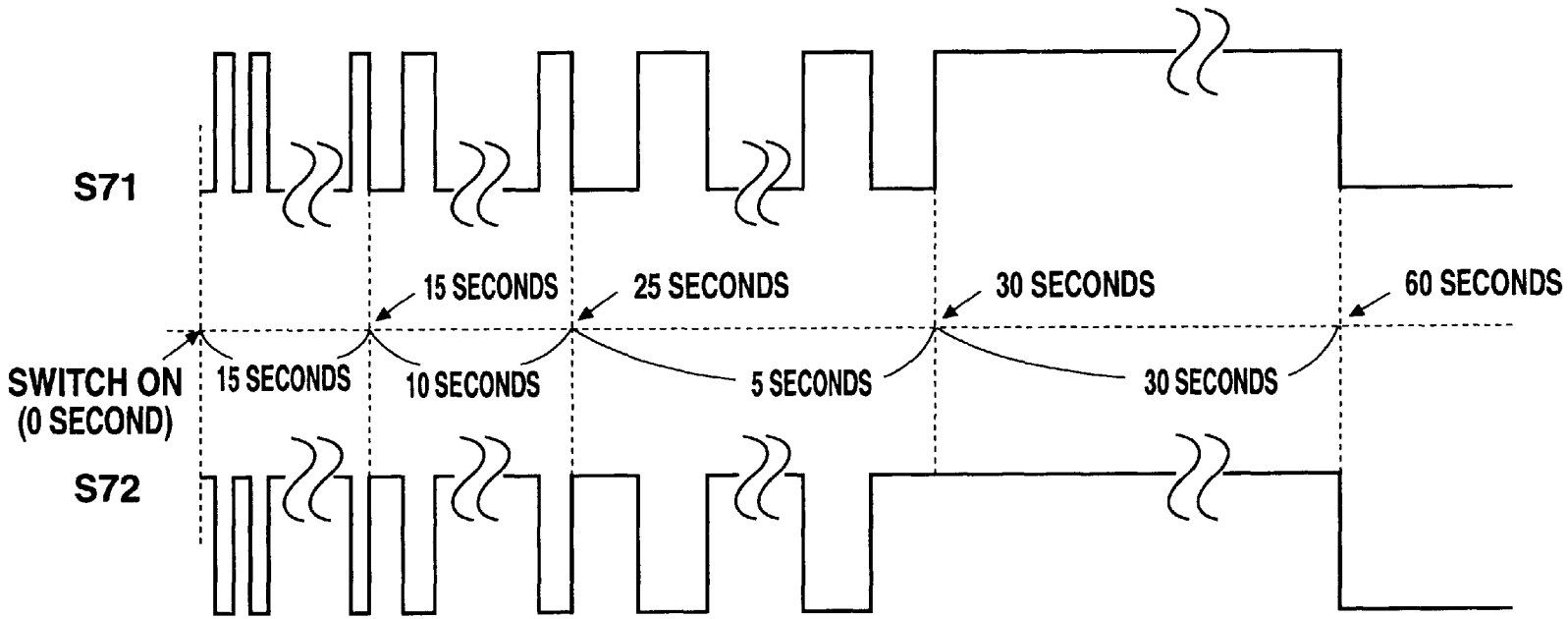
FIG. 18 is a time chart relating to drive signals S71, S72 to be output from a control circuit 307 to a driving circuit 304 of FIG. 17.

FIG. 17 is a circuitry block diagram showing the eighth preferred embodiment with detailed description of the control circuit 307 and the driving circuit 304 of FIG. 13.

Selectors 701, 702 selectively output either of input A or B based on a signal supplied to the C terminal.

Respective timers 703 through 706 continually output an H-level signal during a period from turning-on of the external switch 306 to the lapse of a predetermined time. In this embodiment, the predetermined time is set at 15 seconds, 25 seconds, 30 seconds, and 60 seconds for the timers A, B, C, and D, respectively.

The drawing shows AND gates 707 to 710 and inverters 711 to 713.

An upper segment driving circuit 741 drives the respective segments above the line 451 in FIG. 16, while a lower segment driving circuit 742 drives the respective segments therebelow.

Operation of this embodiment will be described referring to FIGS. 17, 18. FIG. 18 is a time chart indicative of driving signals S71, S72, which are to be output from the control circuit 307 to the driving circuit 304.

When a user wishes to know the time and operates the external switch 306, the timers 703 through 706 output H-level signals. Thus, the selector A 701 selects a signal of 32 Hz and outputs the signal intact to the selector B. The selector B in turn outputs the received 32 Hz signal intact. As the timers 705, 706 also output H-level signals, the control circuit 307 outputs driving signals S71, S72, as shown in FIG. 18, to the driving circuit 304. As the segment driving circuits 741, 742 drive segments only while they receive an H-level driving signals S71, S72, the upper and lower segments are alternatingly driven. Note that those segments which are then driven are only those effective for time indication.

After a set period, such as fifteen seconds, the timer A 703 expires and the output therefrom becomes L-level. Then, the selector A701 outputs a signal of 16 Hz. As the other timers B, C, D 704, 705, 706 continue to output "H" level signals, the control circuit 307 outputs a 16 Hz signal, as indicated after the 15 second line in FIG. 18. Therefore, the respective segments in the display device are alternatingly driven in a 16 Hz cycle.

In a further ten seconds, the timer B 704 expires and outputs an L-level signal. Accordingly, the respective segments in the display device are alternatingly driven in a 16 Hz cycle.

In a still further five seconds, timer C 705 expires and outputs an L-level signal. Accordingly, the AND gates 707, 708 output an L-level signal. Therefore, the control circuit 307 outputs an L-level signal for both upper and lower segments of the display device, as shown after the 30-second line in FIG. 18. This state remains in sixty seconds until time is up for the timer D 706. After another thirty seconds, output of a driving signal is suspended, and the display device then returns to the initial state.

In the above, a not-limiting preferred embodiment has been described in which a driving cycle for the display device becomes gradually longer. Alternatively, various other modification can be made to a cycle by providing a larger number of timers, selectors, and so on. Changing a time to set on the respective timers may also effective to add more variation in a displaying manner.

The present invention is also not limited to the structure shown in FIG. 16(*a*), in which the central segments in contact with the broken line 451 are grouped into the lower segment group. These segments may be grouped into the upper segment group, or may be operated all the time as long as a driving signal is output from the driving circuit 304.

Further, differing from the above, in which all segments are turned off immediately after all segments are lit, the frequency may be gradually increased to thereby turn off all segments. In addition, a frequency (cycle) variation pattern for lighting can be freely changed. Still further, segments may be divided not only into upper and lower groups, but also to right and left groups, or even into more than two groups. In this case, the respective groups may be sequentially driven.

The present invention is not limited to an arrangement for displaying hours and minutes only, as is described in the sixth, seventh, and eighth preferred embodiments. Similar control can be applied also in displaying any information other than time, such as seconds and dates.

The present invention is not limited to a blue reflection panel as shown in FIG. 12, and a reflection type polarizer may be disposed on the upper surface of the liquid crystal cell.

Differing from the sixth, seventh, and eighth preferred embodiment, in which any not-driven segments and background 200 are arranged to present metal-like appearance in contrast to the driven segments, an opposite manner of displaying may also be achievable by rotating the positional relationship between the polarizer 221 and the reflection type polarizer 223 by 90 degrees from that is shown in FIG. 12 (i.e., by setting the transmission axis 221*a* of the normal polarizer 221 and the reflection axis 223*b* of the reflection type polarizer 223 in parallel to each other).

An emission element such as an EL panel may be employed rather than reflection panel described above. With this arrangement, the emission element is driven in conjunction with a switch for retrieving time information or the like, which is also effective to suppress a power consumption increase.

Instead of using a switch to retrieve time information, as in the above, a switch may be used to activate other functions (e.g., an alarm time, or the like) while the time is continuously displayed.

Though the sixth, seventh, and eighth preferred embodiments were described using examples wherein liquid crystal cell segments were controlled for time display, similar display can be achieved with provision of a dedicated liquid crystal cell for display shielding.

In the above description, an electronic watch is used as an example of a popular portable electronic device. However, the present invention is not limited to an electronic watch, and obviously may be applied to various other devices with displays, such as pagers, electronic datebooks, game devices, calculators, portable telephones, and on the like, without departing from the scope of the present invention.

Industrial Applicability

As described above, the present invention is applicable to any electronic devices having a display, such as a wristwatch, pager, electronic datebook, portable telephone, or any other compact information device.

What is claimed is:

1. An electronic device having a display section for displaying information and a shutter control means, wherein the display section, which has a plurality of display arrays including at least a time display and a plurality of other information display arrays, has a light modulating section, having above or below the display section a reflection type polarizer, for varying a light axis of a transmitting light, wherein said light modulating section includes a shutter device adapted to selectively shield at least one of said other information display arrays, and wherein said shutter control means includes a shutter open/close circuit and a shutter driving circuit both adapted to operate said shutter device.

2. An electronic device having a display section according to claim 1, wherein the display section comprises a digital display section and the light modulating section is disposed above the display section, wherein the light modulating section is adapted to selectively shield the digital display section.

3. An electronic device having a display section and a shutter control means, wherein the display section, which is able to display at least time and other information, comprises:

an analog time display section;

a digital display section stacked or put side by side with the analog time display section; and a light modulating section for varying a light axis of a transmitting light above the analog time display section and the digital display section, wherein said light modulating section includes a shutter device adapted to selectively shield at least one of the analog time display section or the digital display section;

wherein said shutter control means includes a shutter open/close circuit and a shutter driving circuit both adapted to operate said shutter device.

4. An electronic device having a display section according to claim 3, further including a reflection type polarizer arranged above or below the light modulating section.

5. An electronic device having a display section capable of displaying information in a form of a liquid crystal display electronic watch having information preparation means for preparing information, an LCD device for displaying the information, a shutter device adapted to be electronically operated by a shutter open/close circuit and a shutter driving circuit, and driving means for driving the LCD device, comprising:

an external switch for switching driving or not driving of display of the LCD device by the driving means, wherein the LCD device has at least one reflection type polarizer, and either a segment being driven by the driving means or a segment being not driven by the driving means presents a metallic appearance, the segments constituting the LCD display and the segments being controlled to be driven sequentially.

6. An electronic device having a display section according to claim 5, where a part of the LCD section having no segment disposed therein presents metal-like appearance.

7. An electronic device having a display section according to claim 5, where a part of the liquid crystal display section having no segment disposed therein is transmissive.

8. An electronic device having a display section according to claim 6 or 7, further comprising a control circuit for controlling the driving circuit, based on operation of the external switch, such that the LCD device displays the time information or the like.

9. An electronic device having a display section according to claim 8, wherein the control circuit controls the driving circuit such that segments of the liquid crystal display section are sequentially driven, beginning with an endmost segment of the LCD device.

10. An electronic device having a display section according to claim 8, wherein the segments of the LCD device are divided into two or more groups so that the control circuit controls the driving circuit to drive the divided segments sequentially and periodically.

11. An electronic device having a display section according to claim 8, wherein the segments of the LCD device are divided into two or more groups, including upper and lower groups, so that the control circuits controls the divided segments sequentially and periodically.

12. An electronic device having a display section according to claim 11, wherein a switching frequency supplied from the driving circuit for driving the segments is gradually changed as time passes.

13. An electronic device having a display section according to claim 12, wherein a switching frequency supplied from the driving circuit for driving the segments is gradually changed as time passes until all segments are driven.

14. An electronic device having a display section according to claim 13, wherein the all segments are turned off after being driven.

15. An electronic device having a display section according to claim 1, wherein, the display section further comprises a digital display section having a plurality of display arrays, and is provided with the light modulating section for varying a light axis of a transmitting light, wherein the light modulating section is adapted to selectively shield at least one of the plurality of display arrays.

16. An electronic device having a display section according to claim 15, wherein one of the plurality of display arrays is a time display section and the other of the plurality of display arrays is a time period display section.

17. An electronic device having a display section according to claim 15, wherein one of the plurality of display arrays is a time display section and the other of the plurality of display arrays is an information display section for displaying information.

18. An electronic device having a display section according to claim 17, wherein the information display section has a confidential information display section subject to control for shielding by a secret display operation switch means.

19. An electronic device having a display section according to claim 1, wherein the display section has a plurality of display characters, including a number, a letter, a symbol, and so on, wherein at least one of the plurality of display characters is able to be shielded.

* * * * *

UNITED STATES PATENT AND TRADEMARK OFFICE

CERTIFICATE OF CORRECTION

PATENT NO. : 6,661,743 B1
DATED : December 9, 2003
INVENTOR(S) : Masahiro Sase et al.

It is certified that error appears in the above-identified patent and that said Letters Patent is hereby corrected as shown below:

Title page,
Item [75], Inventors, "Masao Mafune, Kawagoe (JP);" should be deleted.

Signed and Sealed this

Eleventh Day of May, 2004

JON W. DUDAS
*Acting Director of the United States Patent and Trademark Office*